US009931542B2

(12) United States Patent
Inoue et al.

(10) Patent No.: US 9,931,542 B2
(45) Date of Patent: Apr. 3, 2018

(54) GOLF BALL

(71) Applicant: DUNLOP SPORTS CO. LTD., Kobe-shi, Hyogo (JP)

(72) Inventors: Hidetaka Inoue, Kobe (JP); Kazuya Kamino, Kobe (JP); Kohei Mimura, Kobe (JP); Toshiyuki Tarao, Kobe (JP); Mami Tanaka, Kobe (JP)

(73) Assignee: DUNLOP SPORTS CO. LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/645,144

(22) Filed: Jul. 10, 2017

(65) Prior Publication Data

US 2018/0036599 A1 Feb. 8, 2018

(30) Foreign Application Priority Data

Aug. 5, 2016 (JP) ..... 2016-154528

(51) Int. Cl.
*A63B 37/12* (2006.01)
*A63B 37/00* (2006.01)

(52) U.S. Cl.
CPC ..... *A63B 37/0012* (2013.01); *A63B 37/0003* (2013.01); *A63B 37/0038* (2013.01)

(58) Field of Classification Search
CPC ..... A63B 37/002; A63B 37/0006
USPC ..... 473/378, 380, 384
See application file for complete search history.

(56) References Cited

U.S. PATENT DOCUMENTS

| | | | |
|---|---|---|---|
| 2007/0149321 | A1 | 6/2007 | Sajima |
| 2007/0173354 | A1 | 7/2007 | Sajima |
| 2011/0098133 | A1 | 4/2011 | Shiga et al. |
| 2013/0196791 | A1 | 8/2013 | Sajima et al. |
| 2015/0182804 | A1 | 7/2015 | Tarao et al. |

FOREIGN PATENT DOCUMENTS

| | | | |
|---|---|---|---|
| JP | 2007-175267 | A | 7/2007 |
| JP | 2007-195591 | A | 8/2007 |
| JP | 2011-92328 | A | 5/2011 |
| JP | 2013-153966 | A | 8/2013 |
| JP | 2015-126772 | A | 7/2015 |

*Primary Examiner* — Raeann Gorden
(74) *Attorney, Agent, or Firm* — Birch, Stewart, Kolasch & Birch, LLP

(57) ABSTRACT

A golf ball 2 includes a main body 4 and a paint film 6. The paint film 6 includes an inner layer 14 and an outer layer 16. A modulus Min of the inner layer 14 is higher than a modulus Mout of the outer layer 16. A difference (Min−Mout) is not less than 25 kgf/cm$^2$. The golf ball 2 has a plurality of dimples 18. A ratio So of a sum of areas of the dimples 18 relative to a surface area of a phantom sphere of the golf ball 2 and a ratio Rs of a number of the dimples 18 each having a diameter of not less than 9.60% and not greater than 10.37% of a diameter of the golf ball 2, relative to a total number of the dimples 18, satisfy the following mathematical formula (1).

$$Rs \geq -2.5*So+273 \quad (1)$$

13 Claims, 32 Drawing Sheets

D D D D D D C C C

GOLF BALL

This application claims priority on Patent Application No. 2016-154528 filed in JAPAN on Aug. 5, 2016. The entire contents of this Japanese Patent Application are hereby incorporated by reference.

BACKGROUND OF THE INVENTION

Field of the Invention

The present invention relates to golf balls. Specifically, the present invention relates to golf balls having a paint film and dimples.

Description of the Related Art

When a golf ball is hit with a golf club, the golf ball flies with backspin. When the rate of the backspin is high, the run of the golf ball after landing is short. By using a golf ball having a high backspin rate, a golf player can cause the golf ball to stop at a target point. A golf ball to which backspin is easily provided has excellent controllability. Golf players particularly place importance on controllability upon an approach shot.

JP2011-092328 (US2011/0098133) discloses a golf ball including a cover of which the base material is a polyurethane. The number average molecular weight of the polyol component of the polyurethane is not less than 200 and not greater than 1500. The cover can contribute to the controllability of the golf ball.

JP2015-126772 (US2015/0182804) discloses a golf ball having a paint film. The base material of the paint film is a polyurethane. The polyurethane has a 10% modulus of 100 kgf/cm$^2$ or less. The paint film can contribute to the controllability of the golf ball.

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

There have been various proposals for dimples. JP2007-175267 (US2007/0149321) discloses a dimple pattern in which the number of units in a high-latitude region is different from the number of units in a low-latitude region. JP2007-195591 (US2007/0173354) discloses a dimple pattern in which the number of the types of dimples in a low-latitude region is larger than the number of the types of dimples in a high-latitude region. JP2013-153966 (US2013/0196791) discloses a dimple pattern having a high dimple density and small variation in dimple size. A golf club or a golf ball may get wet with rain or the like. A state where a golf club or a golf ball is wet is referred to as wet state. On the other hand, a state where a golf club or a golf ball is not wet is referred to as dry state. A flexible paint film can contribute to controllability in a dry state. However, according to the findings by the present inventor, the spin rate, in a wet state, of a golf ball having this paint film is not sufficient.

The greatest interest to golf players concerning golf balls is flight distance. Golf players place importance on flight distances with a driver, a long iron, and a middle iron. In light of controllability upon an approach shot, the spin performance of golf balls is important. On the other hand, excessive spin impairs the flight performance of golf balls.

An object of the present invention is to provide a golf ball having excellent controllability upon an approach shot in a dry state and in a wet state and further having excellent flight performance.

SUMMARY OF THE INVENTION

A golf ball according to the present invention includes a main body and a paint film positioned outside the main body. The paint film includes an inner layer and an outer layer positioned outside the inner layer. A 10% modulus Min of the inner layer is higher than a 10% modulus Mout of the outer layer. A difference (Min−Mout) between the modulus Min and the modulus Mout is not less than 25 kgf/cm$^2$. The golf ball has a plurality of dimples on a surface thereof. A ratio So of a sum of areas of the dimples relative to a surface area of a phantom sphere of the golf ball is not less than 81.0%. A ratio Rs of a number of the dimples each having a diameter of not less than 9.60% and not greater than 10.37% of a diameter of the golf ball, relative to a total number of the dimples, is not less than 50%. A dimple pattern of each hemisphere of the phantom sphere includes three units that are rotationally symmetrical to each other. A dimple pattern of each unit includes two small units that are mirror-symmetrical to each other. The golf ball satisfies the following mathematical formula (1).

$$Rs \geq -2.5*So+273 \quad (1)$$

The golf ball according to the present invention has excellent controllability upon an approach shot in a dry state. The golf ball has excellent controllability upon an approach shot in a wet state. Furthermore, the golf ball also has excellent flight performance.

Preferably, the modulus Min is not less than 100 kgf/cm$^2$. Preferably, the modulus Mout is less than 100 kgf/cm$^2$.

Preferably, the inner layer has a thickness Tin of not less than 5 μm and not greater than 30 μm. Preferably, the outer layer has a thickness Tout of not less than 5 μm and not greater than 30 μm.

The inner layer can be formed from a resin composition. Preferably, a base resin of the resin composition is a polyurethane.

The outer layer can be formed from a resin composition. Preferably, a base resin of the resin composition is a polyurethane.

Preferably, the golf ball satisfies the following mathematical formula (2).

$$Rs \geq -2.5*So+278 \quad (2)$$

Preferably, the golf ball satisfies the following mathematical formula (3).

$$Rs \geq -2.5*So+283 \quad (3)$$

Preferably, a ratio Rs' of a number of the dimples each having a diameter of not less than 10.10% and not greater than 10.37% of the diameter of the golfball, relative to the total number of the dimples, is not less than 50%. Preferably, the golf ball satisfies the following mathematical formula (4).

$$Rs' \geq -2.2*So+245 \quad (4)$$

Preferably, the golf ball satisfies the following mathematical formula (5).

$$Rs' \geq -2.2*So+252 \quad (5)$$

Preferably, a depth of a deepest part of each dimple from a surface of the phantom sphere is not less than 0.10 mm and not greater than 0.65 mm. Preferably, a total volume of the dimples is not less than 450 $mm^3$ and not greater than 750 $mm^3$. Preferably, a total number of the dimples is not less than 250 and not greater than 450.

DESCRIPTION OF THE PREFERRED EMBODIMENTS

The following will describe in detail the present invention based on preferred embodiments with appropriate reference to the drawings.

Figure 1:
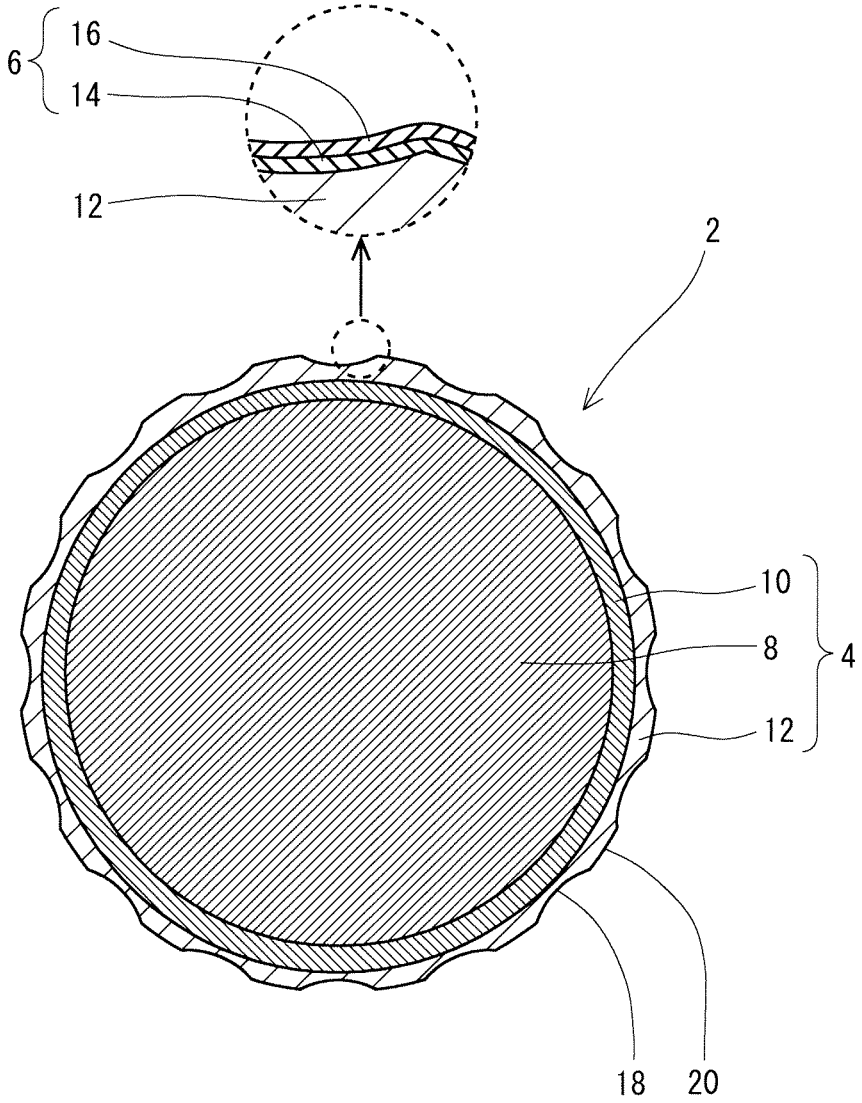
FIG. 1 is a cross-sectional view of a golf ball according to one embodiment of the present invention.

A golf ball 2 shown in FIG. 1 includes a main body 4 and a paint film 6 positioned outside the main body 4. The main body 4 includes a spherical core 8, a mid layer 10 positioned outside the core 8, and a cover 12 positioned outside the mid layer 10. The paint film 6 includes an inner layer 14 positioned outside the main body 4, and an outer layer 16 positioned outside the inner layer 14. The golf ball 2 has a plurality of dimples 18 on the surface thereof. Of the surface of the golf ball 2, a part other than the dimples 18 is a land 20. The golf ball 2 may include a mark layer. The mark layer may be positioned between the cover 12 and the paint film 6, or may be positioned outside the paint film 6. The paint film 6 may include three or more layers.

The golf ball 2 preferably has a diameter of not less than 40 mm and not greater than 45 mm. From the standpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The golf ball 2 preferably has a weight of not less than 40 g and not greater than 50 g. In light of attainment of great inertia, the weight is more preferably not less than 44 g and particularly preferably not less than 45.00 g. From the standpoint of conformity to the rules established by the USGA, the weight is particularly preferably not greater than 45.93 g.

[Core]

The core 8 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferable, and high-cis polybutadienes are particularly preferable.

The rubber composition of the core 8 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 8 may include additives such as a filler, sulfur, a vulcanization accelerator, a sulfur compound, an anti-aging agent, a coloring agent, a plasticizer, and a dispersant. The rubber composition may include a carboxylic acid or a carboxylate. The rubber composition may include synthetic resin powder or cross-linked rubber powder.

The core 8 has a diameter of preferably not less than 30.0 mm and particularly preferably not less than 38.0 mm. The diameter of the core 8 is preferably not greater than 42.0 mm and particularly preferably not greater than 41.5 mm. The core 8 may include two or more layers. The core 8 may have a rib on the surface thereof. The core 8 may be hollow.

[Mid Layer]

The mid layer 10 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable a-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, the resin composition of the mid layer 10 may include another polymer. Examples of the other polymer include polystyrenes, polyamides, polyesters, polyolefins, and polyurethanes. The resin composition may include two or more polymers.

The resin composition of the mid layer 10 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 10 has a thickness of preferably not less than 0.2 mm and particularly preferably not less than 0.3 mm. The thickness of the mid layer 10 is preferably not greater than 2.5 mm and particularly preferably not greater than 2.2 mm. The mid layer 10 has a specific gravity of preferably not less than 0.90 and particularly preferably not less than 0.95. The specific gravity of the mid layer 10 is preferably not greater than 1.10 and particularly preferably not greater than 1.05. The mid layer 10 may include two or more layers.

[Cover]

The cover 12 is formed from a resin composition. A preferable base polymer of the resin composition is a polyurethane. The resin composition may include a thermoplastic polyurethane or may include a thermosetting polyurethane. In light of productivity, the thermoplastic polyurethane is preferable. The thermoplastic polyurethane includes a polyurethane component as a hard segment, and a polyester component or a polyether component as a soft segment. The cover 12 of which the base material is the polyurethane can contribute to the controllability of the golf ball 2.

The polyurethane has a urethane bond within the molecule. The urethane bond can be formed by reacting a polyol with a polyisocyanate.

The polyol, which is a material for the urethane bond, has a plurality of hydroxyl groups. Low-molecular-weight polyols and high-molecular-weight polyols can be used.

Examples of an isocyanate for the polyurethane component include alicyclic diisocyanates, aromatic diisocyanates, and aliphatic diisocyanates. Alicyclic diisocyanates are particularly preferable. Since an alicyclic diisocyanate does not have any double bond in the main chain, the alicyclic diisocyanate suppresses yellowing of the cover 12. Examples of alicyclic diisocyanates include 4,4'-dicyclohexylmethane diisocyanate ($H_{12}MDI$), 1,3-bis(isocyanatomethyl)cyclohexane ($H_6XDI$), isophorone diisocyanate (IPDI), and trans-1,4-cyclohexane diisocyanate (CHDI). In light of versatility and processability, $H_{12}MDI$ is preferable.

Instead of a polyurethane, the resin composition of the cover 12 may include another polymer. Examples of the other polymer include ionomer resins, polystyrenes, polyamides, polyesters, and polyolefins. The resin composition may include two or more polymers.

The resin composition of the cover 12 may include a coloring agent such as titanium dioxide, a filler such as barium sulfate, a dispersant, an antioxidant, an ultraviolet absorber, a light stabilizer, a fluorescent material, a fluorescent brightener, and the like.

The cover 12 has a thickness of preferably not less than 0.2 mm and particularly preferably not less than 0.3 mm. The thickness of the cover 12 is preferably not greater than 2.5 mm and particularly preferably not greater than 2.2 mm. The cover 12 has a specific gravity of preferably not less than 0.90 and particularly preferably not less than 0.95. The specific gravity of the cover 12 is preferably not greater than 1.10 and particularly preferably not greater than 1.05. The cover 12 may include two or more layers.

[Reinforcing Layer]

The golf ball 2 may include a reinforcing layer between the mid layer 10 and the cover 12. The reinforcing layer firmly adheres to the mid layer 10 and also to the cover 12. The reinforcing layer suppresses separation of the cover 12 from the mid layer 10. The reinforcing layer is formed from a polymer composition. Examples of the base polymer of the reinforcing layer include two-component curing type epoxy resins and two-component curing type urethane resins.

[Paint Film]

As described above, the paint film 6 includes the inner layer 14 and the outer layer 16. The inner layer 14 is formed from a resin composition. Examples of the base material of the resin composition include polyurethanes, epoxy resins, acrylic resins, polyvinyl acetate resins, and polyesters. Particularly preferable base resins are polyurethanes.

The outer layer 16 is formed from a resin composition. Examples of the base material of the resin composition include polyurethanes, epoxy resins, acrylic resins, polyvinyl acetate resins, and polyesters. Particularly preferable base resins are polyurethanes.

Typically, each of the inner layer 14 and the outer layer 16 is formed from a polyurethane paint. The paint contains a polyol composition and a polyisocyanate composition. In the paint, a polyol is a base material, and a polyisocyanate is a curing agent.

[Polyol Composition]

The polyol composition contains a polyol compound. The polyol compound has two or more hydroxyl groups within the molecule thereof. The polyol compound may have a hydroxyl group at an end of the molecule thereof, or may have a hydroxyl group at the portion of the molecule other than the ends thereof. The polyol composition may contain two or more polyol compounds.

[Polyol Compound Having Hydroxyl Group at End of Molecule Thereof]

The polyol compound having a hydroxyl group at an end of the molecule thereof includes a low-molecular-weight polyol and a high-molecular-weight polyol. The low-molecular-weight polyol has a number average molecular weight of less than 500. The high-molecular-weight polyol has a number average molecular weight of not less than 500. Examples of the low-molecular-weight polyol include: diols such as ethylene glycol, diethylene glycol, triethylene glycol, 1,3-butanediol, 1,4-butanediol, neopentyl glycol, and 1,6-hexanediol; and triols such as glycerin, trimethylol propane, and hexanetriol. Examples of the high-molecular-weight polyol include: polyether polyols, polyester polyols, polycaprolactone polyols, polycarbonate polyols, urethane polyols, and acrylic polyols. Examples of polyether polyols include polyoxyethylene glycol (PEG), polyoxypropylene glycol (PPG), and polyoxytetramethylene glycol (PTMG). Examples of polyester polyols include polyethylene adipate (PEA), polybutylene adipate (PBA), and polyhexamethylene adipate (PHMA). Examples of polycaprolactone polyols include poly-ϵ-caprolactone (PCL). Examples of polycarbonate polyols include polyhexamethylene carbonate.

[Urethane Polyol]

The urethane polyol has two or more urethane bonds and two or more hydroxyl groups. The urethane polyol can be obtained by causing a reaction of a polyol component and a polyisocyanate component under a condition that the hydroxyl groups of the polyol component are excessive with respect to the isocyanate groups of the polyisocyanate component.

Examples of the polyol component, which is a starting material of the urethane polyol, include polyether diols, polyester diols, polycaprolactone diols, and polycarbonate diols. A preferable polyol component is a polyether diol. Examples of the polyether diol include polyoxyethylene glycol, polyoxypropylene glycol, and polyoxytetramethylene glycol. A preferable polyether diol is polyoxytetramethylene glycol.

The polyether diol preferably has a number average molecular weight of not less than 600. The polyether diol having a number average molecular weight of not less than 600 can contribute to the flexibility of the paint film 6. In this respect, the molecular weight is more preferably not less than 650 and particularly preferably not less than 700. The molecular weight is preferably not greater than 3000. The polyether diol having a molecular weight of not greater than 3000 can contribute to the stain resistance of the paint film 6. In this respect, the molecular weight is more preferably not greater than 2500 and particularly preferably not greater than 2000. The number average molecular weight of the polyol component is measured by gel permeation chromatography (GPC). The measurement conditions are as follows.

Reference material: polystyrene

Eluant: tetrahydrofuran

Column: organic solvent GPC column ("Shodex KF Series" manufactured by Showa Denko K. K.)

The content of the polyether diol in the urethane polyol is preferably not less than 70% by weight. The urethane polyol of which the content is not less than 70% by weight can contribute to the flexibility of the paint film 6. In this respect, the content is more preferably not less than 72% by weight and particularly preferably not less than 75% by weight.

A low-molecular-weight polyol can be used as the polyol component, which is the starting material of the urethane polyol. Examples of the low-molecular-weight polyol include: diols such as ethylene glycol, diethylene glycol, triethylene glycol, 1,3-butanediol, 1,4-butanediol, neopentyl glycol, and 1,6-hexanediol; and triols such as glycerin, trimethylol propane, and hexanetriol. Two or more low-molecular-weight polyols may be used as the starting material.

A urethane polyol for which a diol and a triol are used in combination as the starting material is preferable. The weight ratio (triol component/diol component) of the triol component and the diol component is preferably not less than 0.2 and particularly preferably not less than 0.5. The weight ratio is preferably not greater than 6.0 and particularly preferably not greater than 5.0. A triol suitable to be used in combination with a diol is trimethylol propane.

The polyisocyanate component, which is a starting material of the urethane polyol, has two or more isocyanate groups. Examples of the polyisocyanate component include: aromatic polyisocyanates such as 2,4-toluene diisocyanate, 2,6-toluene diisocyanate, a mixture (TDI) of 2,4-toluene diisocyanate and 2,6-toluene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and paraphenylene diisocyanate (PPDI); alicyclic polyisocyanates such as 4,4'-dicyclohexylmethane diisocyanate ($H_{12}$MDI), hydrogenated xylylene diisocyanate ($H_6$XDI), hexamethylene diisocyanate (HDI), isophorone diisocyanate (IPDI), and norbornene diisocyanate (NBDI); and aliphatic diisocyanates. As the starting material, two or more polyisocyanates may be used.

The urethane polyol preferably has a weight average molecular weight of not less than 5000. The urethane polyol having a weight average molecular weight of not less than 5000 can contribute to the flexibility of the paint film 6. In this respect, the molecular weight is more preferably not less than 5300 and particularly preferably not less than 5500. The molecular weight is preferably not greater than 20000. The urethane polyol having a molecular weight of not greater than 20000 can contribute to the stain resistance of the paint film 6. In this respect, the molecular weight is more preferably not greater than 18000 and particularly preferably not greater than 16000.

The urethane polyol has a hydroxyl value of preferably not less than 10 mg KOH/g, more preferably not less than 15 mg KOH/g, and particularly preferably not less than 20 mg KOH/g. The hydroxyl value is preferably not greater than 200 mg KOH/g, more preferably not greater than 190 mg KOH/g, and particularly preferably not greater than 180 mg KOH/g. The hydroxyl value is measured according to the standards of "JIS K 1557-1". For the measurement, the acetylation method is adopted.

[Compound Having Hydroxyl Group at Portion of Molecule Other Than Ends Thereof]

Examples of the compound having a hydroxyl group at the portion of the molecule other than the ends thereof include a modified polyrotaxane having a hydroxyl group, and a hydroxyl group-modified vinyl chloride-vinyl acetate copolymer.

[Modified Polyrotaxane Having Hydroxyl Group]

The modified polyrotaxane having a hydroxyl group has cyclodextrins, a linear molecule, and a blocking group. The cyclodextrins are ring molecules. The linear molecule is threaded through the cyclodextrins. The blocking group is located at each of both ends of the linear molecule. The blocking group prevents detachment of the cyclodextrins from the linear molecule. In the polyrotaxane, the cyclodextrins are movable along the linear molecule. When tension is applied to the paint film 6 including the polyrotaxane, the tension is distributed. In the paint film 6, a crack and scuff are less likely to occur.

The cyclodextrins are oligosaccharides having a ring structure. In the cyclodextrins, 6 to 8 D-glucopyranose units are linked to each other by α-1,4-glucoside linkage to form a ring. Examples of the cyclodextrins include α-cyclodextrin (the number of glucoses: 6), β-cyclodextrin (the number of glucoses: 7), and γ-cyclodextrin (the number of glucoses: 8).

α-cyclodextrin is preferable. Two or more types of cyclodextrins may be used in combination.

Examples of the linear molecule include polyalkylenes, polyesters, polyethers, and polyacrylics. Polyethers are preferable, and polyethylene glycol is particularly preferable.

The linear molecule has a weight average molecular weight of preferably not less than 5,000 and particularly preferably not less than 6,000. The molecular weight is preferably not greater than 100,000 and particularly preferably not greater than 80,000.

A linear molecule having functional groups at both ends thereof is preferable. The linear molecule can easily react with the blocking group. Examples of the functional groups include hydroxyl group, carboxy group, amino group, and thiol group.

Examples of a method for preventing detachment of the cyclodextrins by the blocking group include a physical prevention method with a bulky blocking group, and an electrostatic prevention method with an ionic blocking group. Examples of the bulky blocking group include cyclodextrins and adamantane group. The ratio of the number of the cyclodextrins through which the linear molecule is threaded, relative to the maximum number of the cyclodextrins, is preferably not less than 0.06 and not greater than 0.61, more preferably not less than 0.11 and not greater than 0.48, and particularly preferably not less than 0.24 and not greater than 0.41. The paint film 6 in which the ratio falls within the above range has excellent physical properties.

A polyrotaxane in which at least a part of the hydroxyl groups included in each cyclodextrin is modified with a caprolactone chain is preferable. With the polyrotaxane, steric hindrance between each polyrotaxane and the polyisocyanate is alleviated.

Hereinafter, one example of a method for the modification will be described. First, the hydroxyl groups of each cyclodextrin are treated with propylene oxide to be hydroxypropylated. Next, ϵ-caprolactone is added to cause ring-opening polymerization. Accordingly, a caprolactone chain —$(CO(CH_2)_5O)nH$ is bonded to the outside of the ring structure of the cyclodextrin via a —O—$C_3H_6$—O— group. The "n" represents a degree of polymerization, and is preferably a natural number of 1 to 100, more preferably a natural number of 2 to 70, and particularly preferably a natural number of 3 to 40. By the ring-opening polymerization, a hydroxyl group is formed at the other end of the caprolactone chain. The hydroxyl group can react with the polyisocyanate.

The proportion of the hydroxyl groups modified with a caprolactone chain to all the hydroxyl groups (100 mol %) included in the cyclodextrin that has not been modified is preferably not less than 2 mol %, more preferably not less than 5 mol %, and further preferably not less than 10 mol %. The polyrotaxane in which the proportion falls within the above range is hydrophobic. The reactivity of the polyrotaxane with the polyisocyanate is high.

The polyrotaxane preferably has a hydroxyl value of not less than 10 mg KOH/g and not greater than 400 mg KOH/g. The reactivity of the polyrotaxane with the polyisocyanate is high. In this respect, the hydroxyl value is more preferably not less than 15 mg KOH/g and particularly preferably not less than 20 mg KOH/g. The hydroxyl value is more preferably not greater than 300 mg KOH/g and particularly preferably not greater than 220 mg KOH/g.

The polyrotaxane preferably has a weight average molecular weight of not less than 30,000 and not greater than 3,000,000. The polyrotaxane having a molecular weight of not less than 30,000 can contribute to the strength of the paint film 6. In this respect, the molecular weight is more preferably not less than 40,000 and particularly preferably not less than 50,000. The polyrotaxane having a molecular weight of not greater than 3,000,000 can contribute to the flexibility of the paint film 6. In this respect, the molecular weight is more preferably not greater than 2,500,000 and particularly preferably not greater than 2,000,000. The molecular weight is measured by gel permeation chromatography (GPC). The measurement conditions are as follows.

Reference material: polystyrene

Eluant: tetrahydrofuran

Column: organic solvent GPC column ("Shodex KF Series" manufactured by Showa Denko K. K.)

Specific examples of the polyrotaxane modified with polycaprolactone include trade names "SeRM Super Polymer SH3400P", "SeRM Super Polymer SH2400P", and "SeRM Super Polymer SH1310P", manufactured by Advanced Softmaterials Inc.

[Hydroxyl Group-Modified Vinyl Chloride-Vinyl Acetate Copolymer]

The aforementioned hydroxyl group-modified vinyl chloride-vinyl acetate copolymer can contribute to the spin performance of the golf ball 2. The copolymer can be obtained by copolymerization of a monomer having a hydroxyl group, vinyl chloride, and vinyl acetate. Examples of the monomer having a hydroxyl group include polyvinyl alcohol and hydroxyalkyl acrylate. The copolymer can also be obtained by partial saponification or full saponification of a vinyl chloride-vinyl acetate copolymer.

The content of the vinyl chloride component in the hydroxyl group-modified vinyl chloride-vinyl acetate copolymer is preferably not less than 1% by weight, more preferably not less than 20% by weight, and particularly preferably not less than 50% by weight. The content is preferably not greater than 99% by weight and particularly preferably not greater than 95% by weight. Specific examples of the hydroxyl group-modified vinyl chloride-vinyl acetate copolymer include trade names "Solbin A", "Solbin A L", and "Solbin T A3", manufactured by Nissin Chemical Industry Co., Ltd.

[Embodiments of Polyol Composition]

Embodiments of a preferable polyol composition are as follows.

Embodiment 1: a composition including a urethane polyol containing a polyether diol having a number average molecular weight of not less than 600 and not greater than 3000.

Embodiment 2: a composition including a polyrotaxane in which at least a part of the hydroxyl groups included in each cyclodextrin is modified with a caprolactone chain via a —O—$C_3H_6$—O— group.

The proportion of the urethane polyol to the entire polyol compound in the polyol composition of Embodiment 1 is preferably not less than 60% by weight, more preferably not less than 70% by weight, and particularly preferably not less than 80% by weight. The polyol composition may include only the urethane polyol as the polyol compound.

The proportion of the polyrotaxane to the entire polyol compound in the polyol composition of Embodiment 2 is preferably not less than 10% by weight, more preferably not less than 15% by weight, and particularly preferably not less than 20% by weight. The proportion is preferably not greater than 100% by weight, more preferably not greater than 90% by weight, and particularly preferably not greater than 85% by weight.

The polyol composition of Embodiment 2 preferably contains a polycaprolactone polyol. The weight ratio of the polycaprolactone polyol and the polyrotaxane is preferably not less than 0/100, more preferably not less than 5/95, and particularly preferably not less than 10/90. The ratio is preferably not greater than 90/10, more preferably not greater than 85/15, and particularly preferably not greater than 80/20.

The polyol composition of Embodiment 2 preferably contains the aforementioned hydroxyl group-modified vinyl chloride-vinyl acetate copolymer. The proportion of the hydroxyl group-modified vinyl chloride-vinyl acetate copolymer to the entire polyol compound in the polyol composition is preferably not less than 4% by weight and particularly preferably not less than 8% by weight. The proportion is preferably not greater than 50% by weight and particularly preferably not greater than 45% by weight.

[Polyisocyanate Composition]

The above-described polyisocyanate composition contains a polyisocyanate compound. The polyisocyanate compound has two or more isocyanate groups.

Examples of the polyisocyanate compound include: aromatic diisocyanates such as 2,4-toluene diisocyanate, 2,6-toluene diisocyanate, a mixture (TDI) of 2,4-toluene diisocyanate and 2,6-toluene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and paraphenylene diisocyanate (PPDI); alicyclic or aliphatic diisocyanates such as 4,4'-dicyclohexylmethane diisocyanate ($H_{12}$MDI), hydrogenated xylylene diisocyanate ($H_6$XDI), hexamethylene diisocyanate (HDI), isophorone diisocyanate (IPDI), and norbornene diisocyanate (NBDI); and triisocyanates such as an allophanate product, a biuret product, an isocyanurate product, an adduct product of diisocyanates. The polyisocyanate compound may include two or more isocyanates.

The allophanate product can be obtained by a diisocyanate further reacting with a urethane bond formed by a reaction of a diisocyanate and a low-molecular-weight diol. The adduct product can be obtained by a reaction of a diisocyanate and a low-molecular-weight triol such as trimethylol propane, glycerin, or the like. The biuret product has a biuret bond represented by the following chemical formula (1). The isocyanurate product is, for example, represented by the following chemical formula (2).

(1)

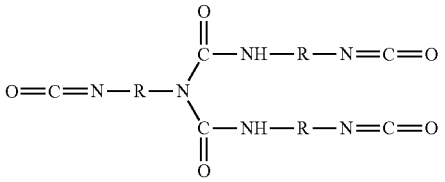

In the chemical formula (1), R represents a residue obtained by eliminating the isocyanate groups from a diisocyanate.

(2)

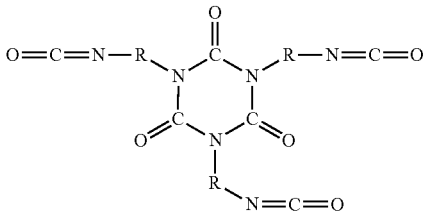

In the chemical formula (2), R represents a residue obtained by eliminating the isocyanate groups from a diisocyanate.

Examples of preferable triisocyanates include an isocyanurate product of hexamethylene diisocyanate, a biuret product of hexamethylene diisocyanate, and an isocyanurate product of isophorone diisocyanate.

Preferably, the polyisocyanate composition contains a triisocyanate compound. The proportion of the triisocyanate compound to the entire polyisocyanate in the polyisocyanate composition is preferably not less than 50% by weight, more preferably not less than 60% by weight, and particularly preferably not less than 70% by weight. The polyisocyanate composition may contain only the triisocyanate compound as the polyisocyanate compound.

The isocyanate group amount (NCO %) of the polyisocyanate contained in the polyisocyanate composition is preferably not less than 0.5% by weight, more preferably not less than 1.0% by weight, and particularly preferably not less than 2.0% by weight. The isocyanate group amount is preferably not greater than 45% by weight, more preferably not greater than 40% by weight, and particularly preferably not greater than 35% by weight. The isocyanate group amount (NCO %) is calculated by the following mathematical formula.

$$NCO=(100\times Mi\times 42)/Wi$$

Mi: the number of moles of the isocyanate groups in the polyisocyanate

42: the molecular weight of NCO

Wi: the total weight (g) of the polyisocyanate

Specific examples of the polyisocyanate include: trade names "BURNOCK D-800", "BURNOCK DN-950", "BURNOCK DN-955", manufactured by DIC corporation; trade names "Desmodur N 75 MPA/X", "Desmodur N 3300", "Desmodur L 75 (C)", and "Sumidur E21-1", manufactured by Sumika Bayer Urethane CO., Ltd.; trade names "CORONATE HX" and "CORONATE HK", manufactured by Tosoh Corporation; trade names "DURANATE 24A-100", "DURANATE 21S-75E", "DURANATE TPA-100", and "DURANATE TKA-100", manufactured by Asahi Kasei Chemicals Corporation; and trade name "VESTANAT T1890" manufactured by Degussa A G.

[Polyol/Polyisocyanate]

The mole ratio (NCO group/OH group) of the hydroxyl group (OH group) of the base material and the isocyanate group (NCO group) of the curing agent in the curing type paint composition is preferably not less than 0.1. In the composition in which the mole ratio (NCO group/OH group) is not less than 0.1, a sufficient curing reaction takes place. In this respect, the mole ratio is particularly preferably not less than 0.2. The mole ratio is preferably not greater than 1.5. The paint film 6 having excellent flexibility and appearance is obtained from the composition in which the mole ratio is not greater than 1.5. In this respect, the ratio is more preferably not greater than 1.4 and particularly preferably not greater than 1.3. The reason why the appearance of the paint film 6 is excellent is that an excessive reaction does not take place between the isocyanate group and the moisture in the air. Suppression of an excessive reaction suppresses generation of carbon dioxide gas, so that impairment of the appearance by the carbon dioxide gas is suppressed.

Polyisocyanate compounds suitable for the polyol composition of Embodiment 1 described above are a biuret-modified product of hexamethylene diisocyanate, an isocyanurate-modified product of hexamethylene diisocyanate, and an isocyanurate-modified product of isophorone diisocyanate. A biuret-modified product of hexamethylene diisocyanate and an isocyanurate-modified product of hexamethylene diisocyanate may be used in combination. In this case, the weight ratio of the biuret-modified product and the isocyanurate-modified product is preferably not less than 20/40 and not greater than 40/20, and particularly preferably not less than 25/35 and not greater than 35/25.

A polyisocyanate compound suitable for the polyol composition of Embodiment 2 described above is an isocyanurate-modified product of hexamethylene diisocyanate.

[Paint]

For the paint film 6, both a water-based paint containing water as a main dispersion medium and a solvent-based paint containing an organic solvent as a dispersion medium can be used. The solvent-based paint is preferable. Examples of a solvent suitable for the solvent-based paint include toluene, isopropyl alcohol, xylene, methyl ethyl ketone, methyl ethyl isobutyl ketone, ethylene glycol monomethyl ether, ethylbenzene, propylene glycol monomethyl ether, isobutyl alcohol, and ethyl acetate. The polyol composition may include a solvent. The polyisocyanate composition may include a solvent. In light of uniform curing reaction, each of the polyol composition and the polyisocyanate composition preferably includes a solvent.

Preferably, the paint contains a leveling agent. The leveling agent can contribute to smoothness of the paint film 6. A preferable leveling agent is a modified silicone. Examples of the modified silicone include a polysiloxane having an organic group introduced to a side chain or an end thereof, a polysiloxane block copolymer obtained by copolymerizing a polyether block, a polycaprolactone block, or the like with a polysiloxane block, and a copolymer obtained by introducing an organic group to a side chain or an end of the polysiloxane block copolymer. The polysiloxane block or the polysiloxane that is linear is preferably modified. Examples of the polysiloxane block or the polysiloxane that is linear include dimethyl polysiloxane, methylphenyl polysiloxane, and methyl hydrogen polysiloxane. Examples of the organic group that can be introduced include amino group, epoxy group, mercapto group, and carbinol group. A preferable modified silicone is a polydimethylsiloxane-polycaprolactone block copolymer. A particularly preferable modified silicone is a modified polydimethylsiloxane-polycaprolactone block copolymer having a carbinol group at an end thereof. The copolymer has excellent compatibility with a caprolactone-modified polyrotaxane and a polycaprolactone polyol. Specific examples of the modified silicone include trade names "DBL-C31", "DBE-224", and "DCE-7521", manufactured by Gelest, Inc.

For a curing reaction, a known catalyst can be used. Examples of preferable catalysts include: monoamines such as triethylamine and N,N-dimethylcyclohexylamine; polyamines such as N,N,N',N'-tetramethylethylenediamine and N,N,N',N",N"-pentamethyldiethylenetriamine; cyclic diamines such as 1,8-diazabicyclo-[5.4.0]-7-undecene (DBU) and triethylenediamine; and tin-based catalysts such as dibutyltin dilaurate and dibutyltin diacetate. Two or more catalysts may be used in combination. Tin-based catalysts are more preferable, and dibutyltin dilaurate is particularly preferable.

The paint may include additives, such as a filler, an ultraviolet absorber, an antioxidant, a light stabilizer, a fluorescent brightener, an anti-blocking agent, a slipping agent, a viscosity modifier, and the like, in an adequate amount.

The paint is applied to the main body 4 or the like by a spray coating method, an electrostatic coating method, or the like. In the case of spray coating with an air gun, a line mixer can be disposed upstream of the air gun. The polyol composition is supplied to the line mixer by a pump. The polyisocyanate composition is supplied to the line mixer by another pump. In the line mixer, the polyol composition and the polyisocyanate composition are continuously mixed. A paint obtained by the mixing is sprayed from the air gun. The polyol composition and the polyisocyanate composition may be applied separately.

A first paint is applied to the main body 4 of the golf ball 2 and dried. Through the drying, the inner layer 14 is obtained. The drying temperature is preferably not lower than 30° C. but not higher than 70° C. The drying time period is preferably not shorter than 1 hour but not longer than 24 hours.

A second paint is applied to the inner layer 14 and dried. Through the drying, the outer layer 16 is obtained. The drying temperature is preferably not lower than 30° C. but not higher than 70° C. The drying time period is preferably not shorter than 1 hour but not longer than 24 hours.

[Physical Properties of Paint Film]

A 10% modulus Min of the inner layer 14 is higher than a 10% modulus Mout of the outer layer 16. The inner layer 14 having a high modulus Min can contribute to a high spin rate in a wet state. The golf ball 2 having the inner layer 14 has excellent controllability upon an approach shot in a wet state. The outer layer 16 having a low modulus Mout can contribute to a high spin rate in a dry state. The golf ball 2 having the outer layer 16 has excellent controllability upon an approach shot in a dry state.

In light of controllability in a wet state and in a dry state, the difference (Min−Mout) between the modulus Min and the modulus Mout is preferably not less than 25 kgf/cm$^2$ (2.5 MPa), more preferably not less than 45 kgf/cm$^2$ (4.4 MPa), and particularly preferably not less than 65 kgf/cm$^2$ (6.4 MPa). In light of adhesion between the inner layer 14 and the outer layer 16, the difference (Min−Mout) is preferably not greater than 400 kgf/cm$^2$ (39.2 MPa), more preferably not greater than 375 kgf/cm$^2$ (36.8 MPa), and particularly preferably not greater than 350 kgf/cm$^2$ (34.3 MPa).

By using a paint having a high mole ratio (NCO/OH) for the inner layer 14 and using a paint having a low mole ratio (NCO/OH) for the outer layer 16, the paint film 6 having a great difference (Min−Mout) can be obtained. By using a polyurethane including a polyol having a low molecular weight for the inner layer 14 and using a polyurethane including a polyol having a high molecular weight for the outer layer 16, the paint film 6 having a great difference (Min−Mout) can be obtained.

The modulus Min is preferably not less than 100 kgf/cm$^2$ (9.8 MPa) and not greater than 500 kgf/cm$^2$ (49.0 MPa). The golf ball 2 in which the modulus Min is not less than 100 kgf/cm$^2$ has excellent controllability in a wet state. In this respect, the modulus Min is more preferably not less than 125 kgf/cm$^2$ (12.3 MPa) and particularly preferably not less than 150 kgf/cm$^2$ (14.7 MPa). The inner layer 14 having a modulus Min of not greater than 500 kgf/cm$^2$ has excellent durability. In this respect, the modulus Min is more preferably not greater than 450 kgf/cm$^2$ (44.1 MPa) and particularly preferably not greater than 400 kgf/cm$^2$ (39.2 MPa).

The maximum elongation (amount of strain at fracture) of the inner layer 14 is preferably not less than 30% and not greater than 200%. The inner layer 14 having a maximum elongation of not less than 30% has excellent durability. In this respect, the maximum elongation is more preferably not less than 40% and particularly preferably not less than 50%. The inner layer 14 having a maximum elongation of not greater than 200% can contribute to controllability in a wet state. In this respect, the maximum elongation is more preferably not greater than 175% and particularly preferably not greater than 150%.

The modulus Mout is preferably equal to or greater than 5 kgf/cm$^2$ (0.5 MPa) and less than 100 kgf/cm$^2$ (9.8 MPa). The outer layer 16 having a modulus Mout of equal to or greater than 5 kgf/cm$^2$ has excellent stain resistance. In this respect, the modulus Mout is more preferably not less than 10 kgf/cm$^2$ (1.0 MPa) and particularly preferably not less than 15 kgf/cm$^2$ (1.5 MPa). The golf ball 2 in which the modulus Mout is less than 100 kgf/cm$^2$ has excellent controllability in a dry state. In this respect, the modulus Mout is more preferably not greater than 90 kgf/cm$^2$ (8.8 MPa) and particularly preferably not greater than 80 kgf/cm$^2$ (7.8 MPa).

The maximum elongation (amount of strain at fracture) of the outer layer 16 is preferably not less than 100% and not greater than 500%. The golf ball 2 including the outer layer 16 having a maximum elongation of not less than 100% has excellent controllability in a dry state. In this respect, the maximum elongation is more preferably not less than 120% and particularly preferably not less than 140%. The outer layer 16 having a maximum elongation of not greater than 500% has excellent stain resistance. In this respect, the maximum elongation is more preferably not greater than 450% and particularly preferably not greater than 400%.

In the present invention, the moduli and the maximum elongations of the inner layer 14 and the outer layer 16 are measured by the tensile test specified in "JIS K7161 (2014)". In the measurement, first, the paint including the base material and the curing agent is applied to a plate, and dried at 40° C. for 4 hours to obtain the paint film 6. The thickness of the paint film 6 is about 0.05 mm. The paint film 6 is punched into the shape of type 2 specified in "JIS K7127 (1999)", to obtain a test piece. In the test piece, the width of a parallel portion is 10 mm, and the distance between reference lines is 50 mm. The test piece is subjected to a tensile test with a precision universal tester (trade name "Autograph" manufactured by Shimadzu Corporation). The test conditions are as follows.

Distance between chucks: 100 mm

Tension speed: 50 mm/min

Test temperature: 23° C.

[Thickness of Paint Film]

The inner layer 14 has a thickness Tin of preferably not less than 5 μm and not greater than 30 μm. The inner layer 14 having a thickness Tin of not less than 5 μm can contribute to controllability in a wet state. In this respect, the thickness Tin is more preferably not less than 7 μm and particularly preferably not less than 8 μm. The inner layer 14 having a thickness Tin of not greater than 30 μm has excellent durability. In this respect, the thickness Tin is more preferably not greater than 27.5 μm and particularly preferably not greater than 25 μm.

The outer layer 16 has a thickness Tout of preferably not less than 5 μm and not greater than 30 μm. The outer layer 16 having a thickness Tout of not less than 5 μm can contribute to controllability in a dry state. In this respect, the thickness Tout is more preferably not less than 7 μm and particularly preferably not less than 8 μm. The outer layer 16 having a thickness Tout of not greater than 30 μm has excellent stain resistance. In this respect, the thickness Tout is more preferably not greater than 27.5 μm and particularly preferably not greater than 25 μm.

The ratio (Tout/Tin) of the thickness Tout of the outer layer 16 and the thickness Tin of the inner layer 14 is preferably not less than 0.2 and not greater than 5. The paint film 6 having a ratio (Tout/Tin) of not less than 0.2 can contribute to controllability in a dry state. In this respect, the ratio (Tout/Tin) is more preferably not less than 0.3 and particularly preferably not less than 0.4. The paint film 6 having a ratio (Tout/Tin) of not greater than 5 has excellent controllability in a wet state. In this respect, the ratio (Tout/Tin) is preferably not greater than 4 and particularly preferably not greater than 3.

The total thickness of the paint film 6 is preferably not less than 10 μm and not greater than 60 μm. The paint film 6 having a total thickness of not less than 10 μm can contribute to controllability in a dry state and in a wet state. In this respect, the total thickness is more preferably not less than 13 μm and particularly preferably not less than 15 μm. The paint film 6 having a total thickness of not greater than 60 μm does not impair the shapes of the dimples 18. In this respect, the total thickness is more preferably not greater than 50 μm and particularly preferably not greater than 40 μm.

[Coefficient of Friction]

The coefficient of friction of the golf ball 2 is preferably not less than 0.35 and not greater than 0.60. The golf ball 2 having a coefficient of friction within this range has excellent controllability upon an approach shot. In this respect, the coefficient of friction is more preferably not less than 0.37 and particularly preferably not less than 0.39. The coefficient of friction is more preferably not greater than 0.56 and particularly preferably not greater than 0.54.

In the present invention, the coefficient of friction is measured with a contact force tester. With the contact force tester, the coefficient of friction between the golf ball 2 and a collisional body that is set so as to be tilted relative to a direction in which the golf ball 2 flies can be measured when the golf ball 2 collides against the collisional body. With the contact force tester, a time function Fn(t) of contact force in a direction perpendicular to the collisional body and a time function Ft(t) of contact force in a direction parallel to the collisional body are obtained simultaneously. The maximum value of a time function M(t) of a ratio calculated by the following mathematical formula is a coefficient of friction.

$$M(t)=Ft(t)/Fn(t)$$

Figure 27:
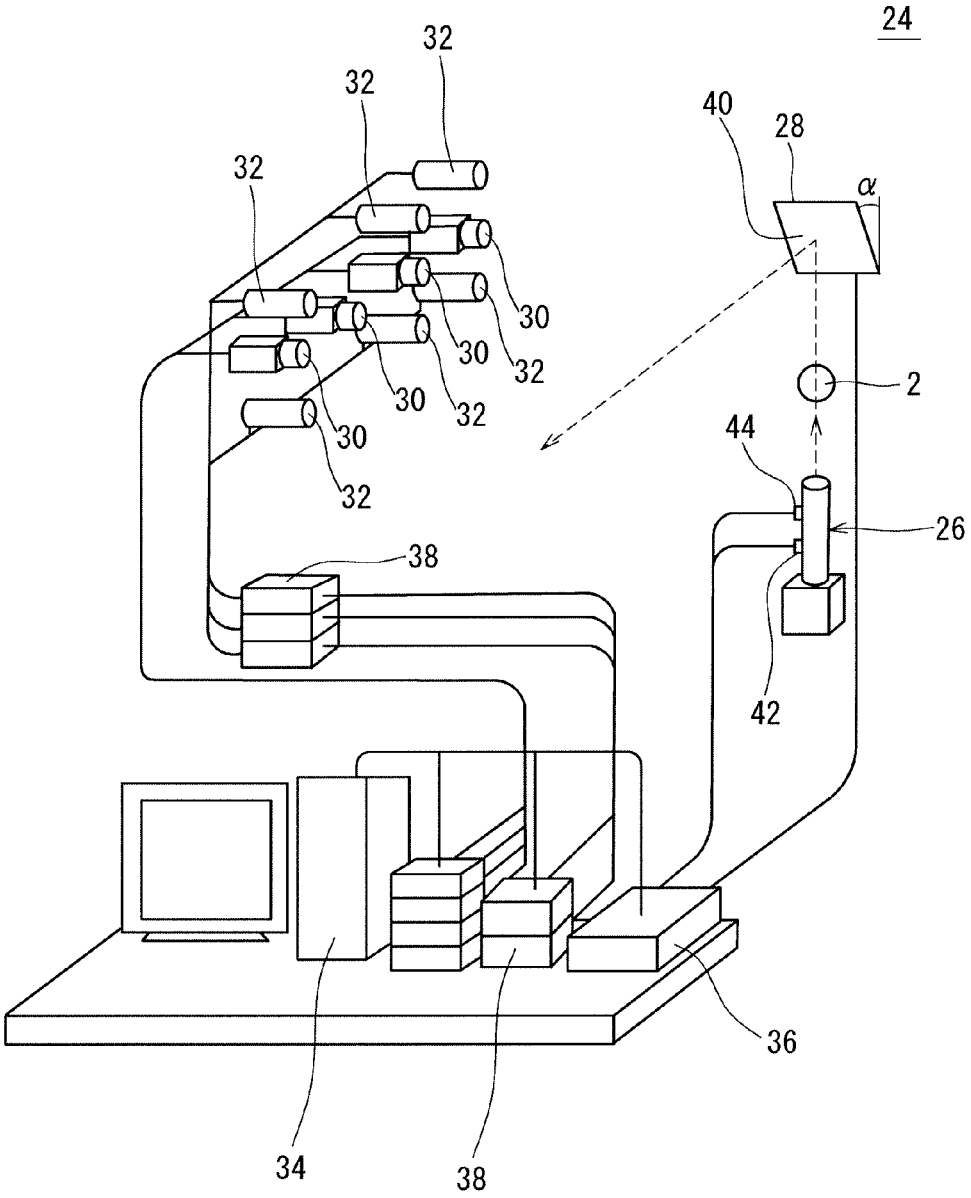
FIG. 27 is a perspective view showing a contact force tester used for measuring the coefficient of friction of a golf ball.

FIG. 27 shows a contact force tester 24. With the contact force tester 24, a state where the golf ball 2 is hit with a clubface is reproduced in a pseudo manner. The contact force tester 24 includes a launching device 26, a collisional body 28, a plurality of cameras 30, a plurality of stroboscopes 32, a computer 34, a controller 36, and a power source 38. In the launching device 26, a so-called air gun method is adopted. The launching device 26 can launch the golf ball 2 upward in the vertical direction. The collisional body 28 is located above the launching device 26. The launched golf ball 2 collides against a collisional surface 40 of the collisional body 28. The golf ball 2 rebounding after the collision is photographed with the cameras 30 and the stroboscopes 32. Image data obtained through the photographing is transmitted to the computer 34. In the computer 34, the launch speed, the launch angle, and the spin rate of the golf ball 2 can be calculated. The contact forces Fn(t) and Ft(t) are also transmitted to the computer 34. For the transmission, a pulse counter board (trade name "PCI-6101") manufactured by Interface Corporation is used. The pulse counter board has four 16-bit channels.

The distance between the launching device 26 and the collisional surface 40 is small. Therefore, the speed of the golf ball 2 at the time of collision is substantially equal to the speed of the golf ball 2 immediately after the golf ball 2 is launched from the launching device 26. The speed of the golf ball 2 corresponds to the head speed of a golf club when a golf player swings the golf club. In this respect, in the contact force tester 24, the speed of the golf ball 2 can be adjusted within the range of not less than 10 m/s and not greater than 70 m/s. In the present invention, the speed of the golf ball 2 is set to 19 m/s in consideration of a head speed upon an approach shot.

The launching device 26 includes a first sensor 42 and a second sensor 44. The speed of the golf ball 2 can be calculated by measuring a time period from the time at which the golf ball 2 moves past the first sensor 42 to the time at which the golf ball 2 moves past the second sensor 44. The result of the calculation is transmitted to the computer 34. The speed of the golf ball 2 can be adjusted on the basis of the volume of the controller 36.

Figure 28:
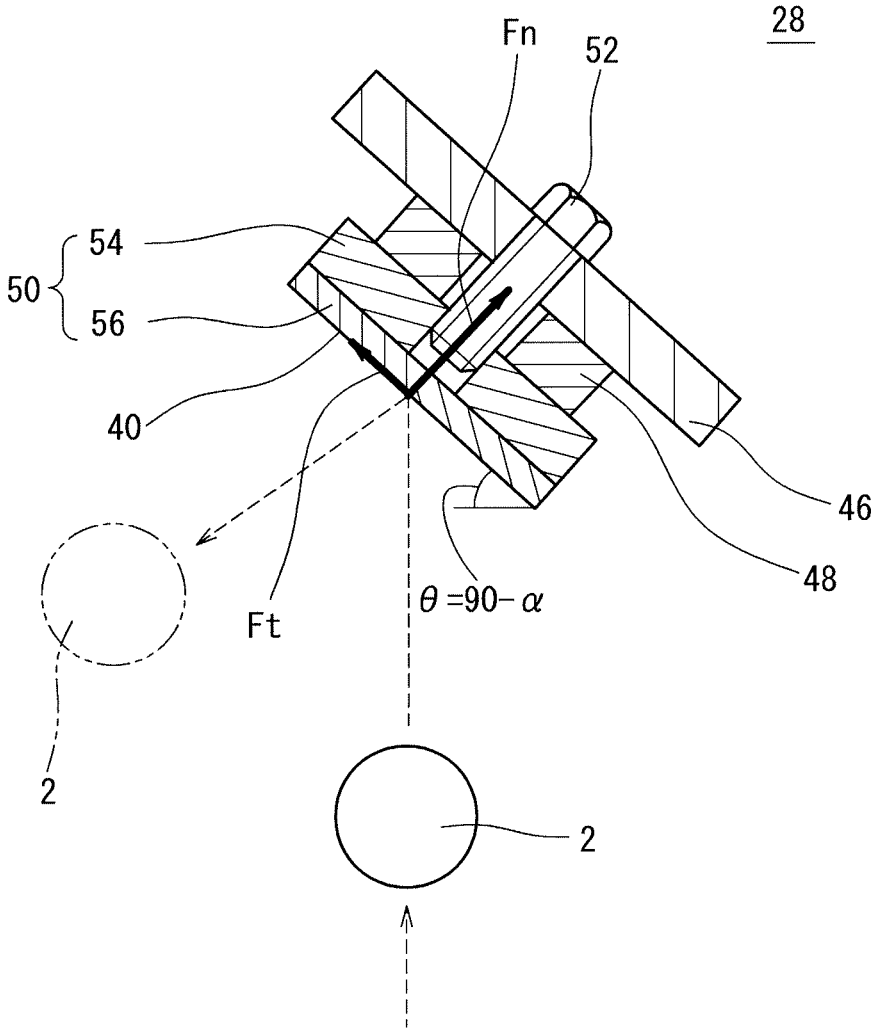
FIG. 28 is an enlarged cross-sectional view showing a collisional body of the contact force tester in FIG. 27.

FIG. 28 is an enlarged cross-sectional view showing the collisional body 28. In the collisional body 28, an angle $\alpha$ of the collisional surface 40 relative to the direction in which the golf ball 2 is launched can be adjusted. An angle $\theta$ obtained by subtracting the angle $\alpha$ from 90° is a collision angle. The collision angle $\theta$ corresponds to the loft angle of the clubface. In the contact force tester 24, the collision angle $\theta$ can be adjusted within the range of not less than 0° and not greater than 90°. In the present invention, the collision angle $\theta$ is set to 55° in consideration of the loft angle of an approach wedge.

The collisional body 28 includes a base 46, a pressure sensor 48, a surface plate 50, and a bolt 52 (M10 of the JIS standard). The base 46, the pressure sensor 48, and the surface plate 50 are integrated with each other by the bolt 52.

The material of the base 46 is steel. The thickness of the base 46 is 5.35 mm.

The pressure sensor 48 is interposed between the base 46 and the surface plate 50. As the pressure sensor 48, a three-component force sensor (three-component force sensor "9067" manufactured by Kistler) is used. The sensor can measure perpendicular force Fn in a direction perpendicular to the collisional surface 40 and shear force Ft in a direction parallel to the collisional surface 40 as time-series data. In the measurement, a charge amplifier ("5011B" manufactured by Kistler) is connected to the pressure sensor 48.

The surface plate 50 includes a main portion 54 and a covering 56. The material of the main portion 54 is stainless steel (SUS-630). The thickness of the main portion 54 is 15 mm. The plane shape of the main portion 54 is substantially the same as the plane shape of the pressure sensor 48 and is a square. One side of the square is 56 mm. The material of the covering 56 is stainless steel (SUS-431). The thickness of the covering 56 is 2.5 mm. The plane shape of the covering 56 is substantially the same as the plane shape of the main portion 54 and is square. One side of the square is 56 mm. The covering 56 has, on the surface thereof, grooves similar to the grooves of an approach wedge. The shapes of the grooves will be described later.

Figure 29:
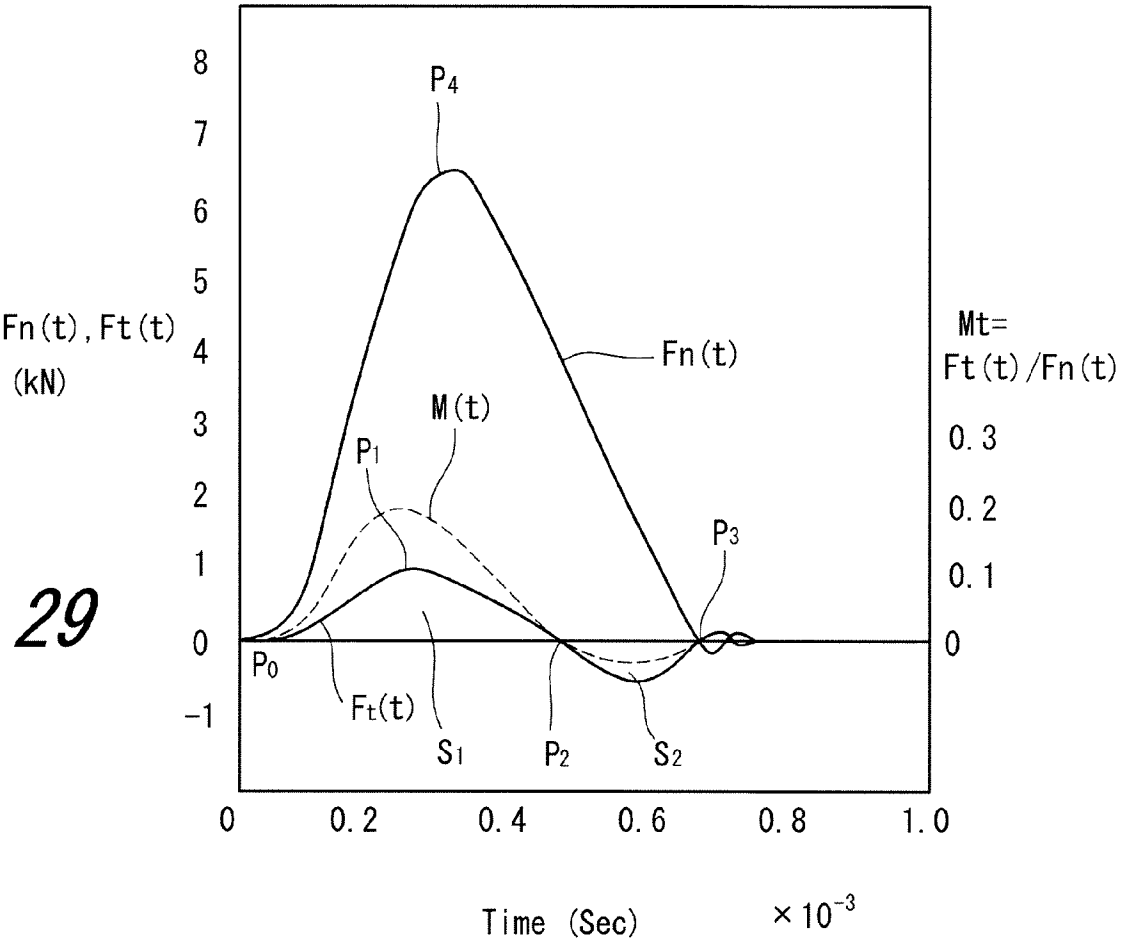
FIG. 29 is a graph showing an example of results obtained by measurement with the contact force tester in FIG. 27.

FIG. 29 is a graph showing an example of results obtained by measurement with the contact force tester 24 in FIG. 27. The graph shows a time history of the perpendicular force Fn and the shear force Ft. In the graph, a point $P_0$ is a point at which the pressure sensor 48 starts sensing force, and corresponds to a time at which a collision between the collisional surface 40 and the golf ball 2 is started. As shown in the graph, the perpendicular force Fn(t) gradually increases from the point $P_0$, reaches a highest value at a point $P_4$, decreases from the point $P_4$, and reaches zero at a point $P_3$. The point $P_3$ is a point at which the pressure sensor 48 no longer senses force, and corresponds to a time at which the golf ball 2 is separated from the collisional surface 40.

The shear force Ft(t) gradually increases from the point $P_0$, reaches a highest value at a point $P_1$, decreases from the point $P_1$, reaches zero at a point $P_2$, and becomes negative after the point $P_2$. The shear force Ft(t) reaches zero at the point $P_3$. An area $S_1$ of a region where Ft(t) has a positive value, of the region surrounded by the curve of Ft(t) and the time axis, represents the impulse of the shear force that is positive. On the other hand, an area $S_2$ of a region where Ft(t) has a negative value, of the region surrounded by the curve of Ft(t) and the time axis, represents the impulse of the shear force that is negative. The impulse $S_1$ acts in a direction in which backspin is accelerated, and the impulse $S_2$ acts in a direction in which backspin is suppressed. The impulse $S_1$ is greater than the impulse $S_2$. The value obtained by subtracting the impulse $S_2$ from the impulse $S_1$ correlates with backspin of the golf ball 2.

[Dimples]

Figure 2:
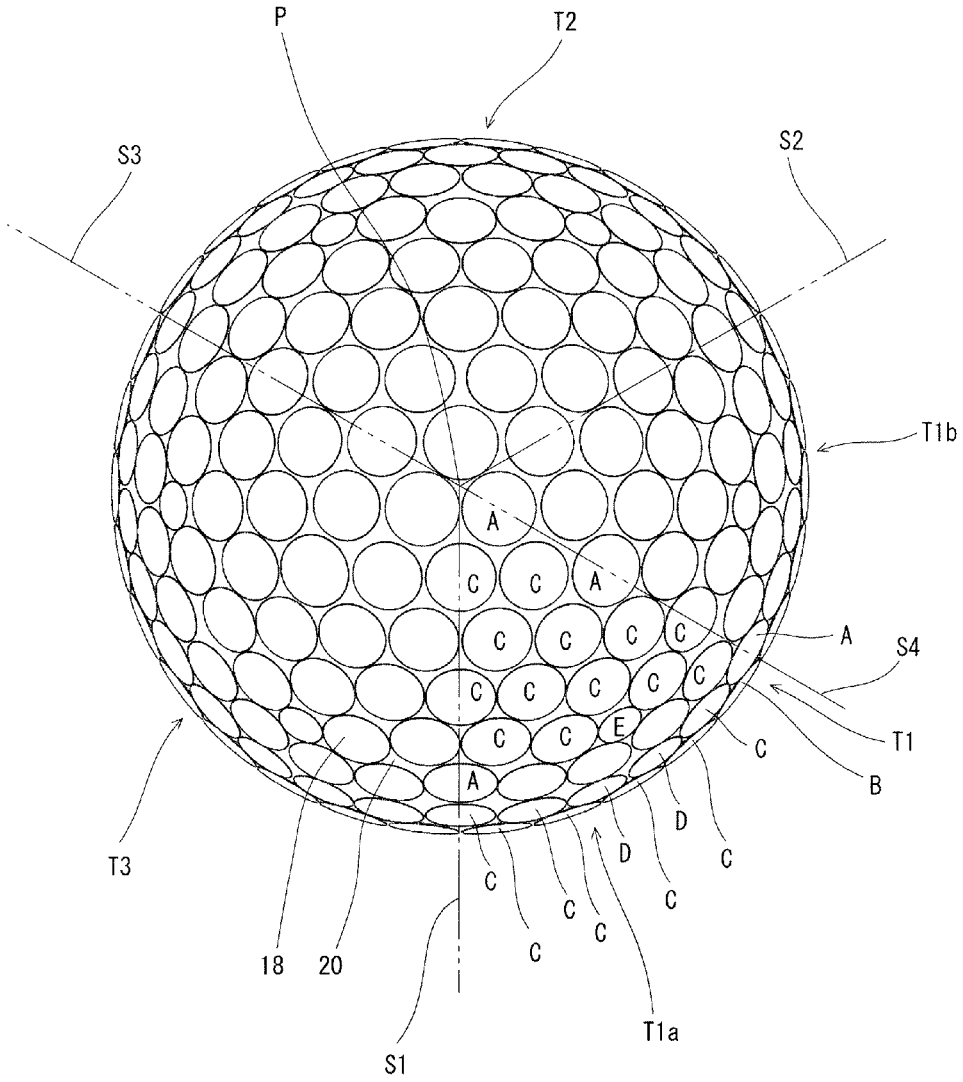
FIG. 2 is a plan view of the golf ball in FIG. 1.
Figure 3:
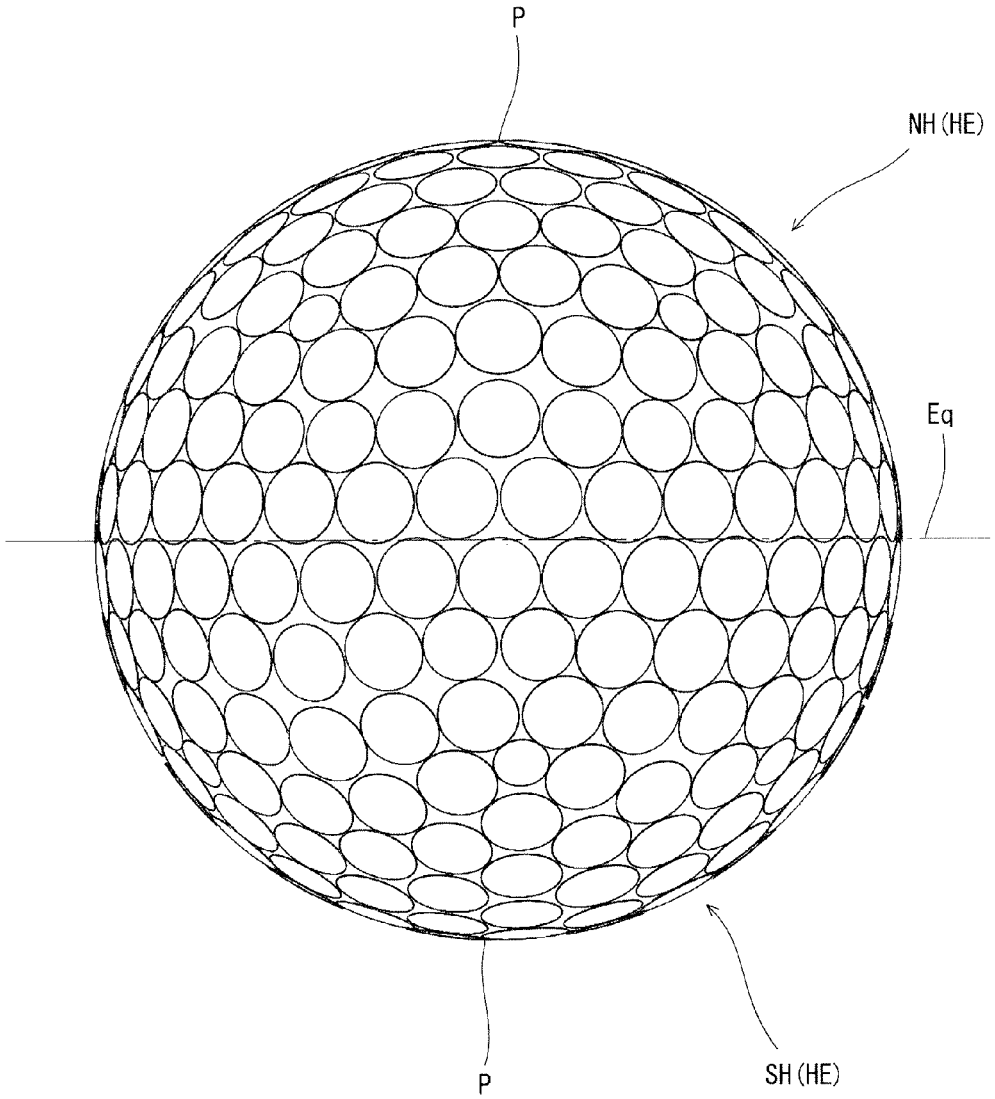
FIG. 3 is a front view of the golf ball in FIG. 2.

As shown in FIGS. 2 and 3, the contour of each dimple 18 is circular. The golf ball 2 has: dimples A each having a diameter of 4.60 mm; dimples B each having a diameter of 4.50 mm; dimples C each having a diameter of 4.35 mm; dimples D each having a diameter of 4.00 mm; and dimples E each having a diameter of 3.00 mm. The number of types of the dimples 18 is five. The golf ball 2 may have non-circular dimples 18 instead of the circular dimples 18 or together with circular dimples 18.

The number of the dimples A is 24, the number of the dimples B is 12, the number of the dimples C is 252, the number of the dimples D is 24, and the number of the dimples E is 12. The total number of the dimples 18 is 324. A dimple pattern is formed by these dimples 18 and the land 20.

Figure 4:
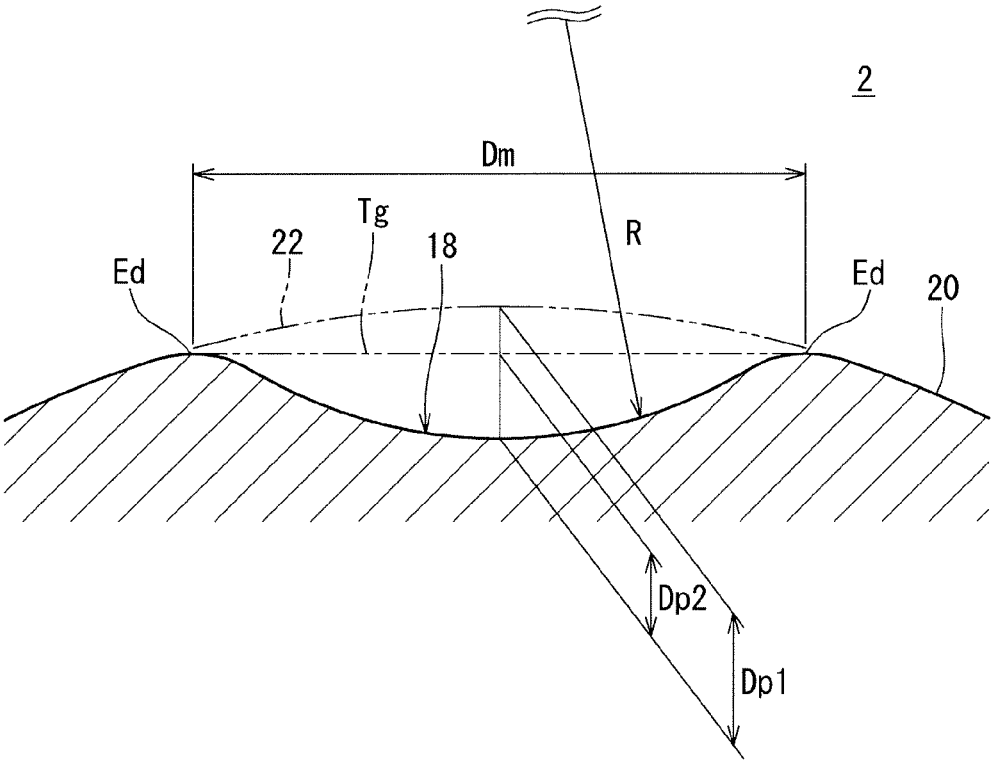
FIG. 4 is a partially enlarged cross-sectional view of the golf ball in FIG. 1.

FIG. 4 shows a cross section of the golf ball 2 along a plane passing through the central point of the dimple 18 and the central point of the golf ball 2. In FIG. 4, the top-to-bottom direction is the depth direction of the dimple 18. In FIG. 4, a chain double-dashed line 22 indicates a phantom sphere. The surface of the phantom sphere 22 is the surface of the golf ball 2 when it is postulated that no dimple 18 exists. The diameter of the phantom sphere 22 is equal to the diameter of the golf ball 2. The dimple 18 is recessed from the surface of the phantom sphere 22. The land 20 coincides with the surface of the phantom sphere 22. In the present embodiment, the cross-sectional shape of each dimple 18 is substantially a circular arc.

In FIG. 4, an arrow Dm indicates the diameter of the dimple 18. The diameter Dm is the distance between two tangent points Ed appearing on a tangent line Tg that is drawn tangent to the far opposite ends of the dimple 18. Each tangent point Ed is also the edge of the dimple 18. The edge Ed defines the contour of the dimple 18. In FIG. 4, a double ended arrow Dp1 indicates a first depth of the dimple 18. The first depth Dp1 is the distance between the deepest part of the dimple 18 and the surface of the phantom sphere 22. In FIG. 4, a double ended arrow Dp2 indicates a second depth of the dimple 18. The second depth Dp2 is the distance between the deepest part of the dimple 18 and the tangent line Tg.

The diameter Dm of each dimple 18 is preferably not less than 2.0 mm and not greater than 6.0 mm. The dimple 18 having a diameter Dm of not less than 2.0 mm contributes to turbulization. The golf ball 2 has excellent flight performance even though the spin rate thereof is high. In this respect, the diameter Dm is more preferably not less than 2.5 mm and particularly preferably not less than 2.8 mm. The dimple 18 having a diameter Dm of not greater than 6.0 mm does not impair a fundamental feature of the golf ball 2 being substantially a sphere. In this respect, the diameter Dm is more preferably not greater than 5.5 mm and particularly preferably not greater than 5.0 mm.

In the case of a non-circular dimple, a circular dimple 18 having the same area as that of the non-circular dimple is assumed. The diameter of the assumed dimple 18 can be regarded as the diameter of the non-circular dimple.

The ratio Pd of the diameter Dm of each dimple 18 relative to the diameter of the golf ball 2 is preferably not less than 9.60% and not greater than 10.37%. The dimple 18 having a ratio Pd of not less than 9.60% contributes to turbulization. The golf ball 2 has excellent flight performance even though the spin rate thereof is high. In this respect, the ratio Pd is more preferably not less than 9.90% and particularly preferably not less than 10.10%. The dimple 18 having a ratio Pd of not greater than 10.37% does not impair a fundamental feature of the golf ball 2 being substantially a sphere.

In this respect, the ratio Pd is more preferably not greater than 10.32% and particularly preferably not greater than 10.27%.

The ratio Rs of the number of the dimples 18 each having a ratio Pd of not less than 9.60% and not greater than 10.37%, relative to the total number of the dimples 18, is preferably not less than 50%. The dimple pattern having a ratio Rs of not less than 50% contributes to turbulization. The golf ball 2 has excellent flight performance even though the spin rate thereof is high. In this respect, the ratio Rs is more preferably not less than 60% and particularly preferably not less than 70%. The ratio Rs may be 100%.

The ratio Rs' of the number of the dimples 18 each having a ratio Pd of not less than 10.10% and not greater than 10.37%, relative to the total number of the dimples 18, is preferably not less than 50%. The dimple pattern having a ratio Rs' of not less than 50% contributes to turbulization. The golf ball 2 has excellent flight performance even though the spin rate thereof is high. In this respect, the ratio Rs' is more preferably not less than 60% and particularly preferably not less than 70%. The ratio Rs' may be 100%.

The ratio of the number of the dimples 18 each having a ratio Pd exceeding 10.37%, relative to the total number of the dimples 18, is preferably less than 50%. With the dimple pattern in which this ratio is less than 50%, the degree of freedom in designing a dimple pattern is high, and therefore the width of the land 20 is less likely to be excessively large. In this respect, this ratio is more preferably not greater than 30% and particularly preferably not greater than 10%. This ratio may be zero.

In light of suppression of rising of the golf ball 2 during flight, the first depth Dp1 of each dimple 18 is preferably not less than 0.10 mm, more preferably not less than 0.13 mm, and particularly preferably not less than 0.15 mm. In light of suppression of dropping of the golf ball 2 during flight, the first depth Dp1 is preferably not greater than 0.65 mm, more preferably not greater than 0.60 mm, and particularly preferably not greater than 0.55 mm.

The area S of the dimple 18 is the area of a region surrounded by the contour line of the dimple 18 when the central point of the golf ball 2 is viewed at infinity. In the case of a circular dimple 18, the area S is calculated by the following mathematical formula.

$$S=(Dm/2)^2*\pi$$

In the golf ball 2 shown in FIGS. 2 and 3, the area of each dimple A is 16.62 $mm^2$, the area of each dimple B is 15.90 $mm^2$, the area of each dimple C is 14.86 $mm^2$, the area of each dimple D is 12.57 $mm^2$, and the area of each dimple E is 7.07 $mm^2$.

In the present invention, the ratio of the sum of the areas S of all the dimples 18 relative to the surface area of the phantom sphere 22 is referred to as an occupation ratio So. From the standpoint that sufficient turbulization is achieved, the occupation ratio So is preferably not less than 81.0% and more preferably not less than 82.0%. The occupation ratio So is preferably not greater than 95%. In the golf ball 2 shown in FIGS. 2 and 3, the total area of the dimples 18 is 4721.1 $mm^2$. The surface area of the phantom sphere 22 of the golf ball 2 is 5728.0 $mm^2$, so that the occupation ratio So is 82.4%.

From the standpoint that a sufficient occupation ratio is achieved, the total number N of the dimples 18 is preferably not less than 250, more preferably not less than 280, and particularly preferably not less than 300. From the standpoint that each dimple 18 can contribute to turbulization, the total number N of the dimples 18 is preferably not greater than 450, more preferably not greater than 400, and particularly preferably not greater than 380.

In the present invention, the "volume of the dimple" means the volume of a portion surrounded by the surface of the phantom sphere 22 and the surface of the dimple 18. In light of suppression of rising of the golf ball 2 during flight, the total volume of all the dimples 18 is preferably not less than 450 $mm^3$, more preferably not less than 480 $mm^3$, and particularly preferably not less than 500 $mm^3$. In light of suppression of dropping of the golf ball 2 during flight, the total volume is preferably not greater than 750 $mm^3$, more preferably not greater than 730 $mm^3$, and particularly preferably not greater than 710 $mm^3$.

Figure 5:
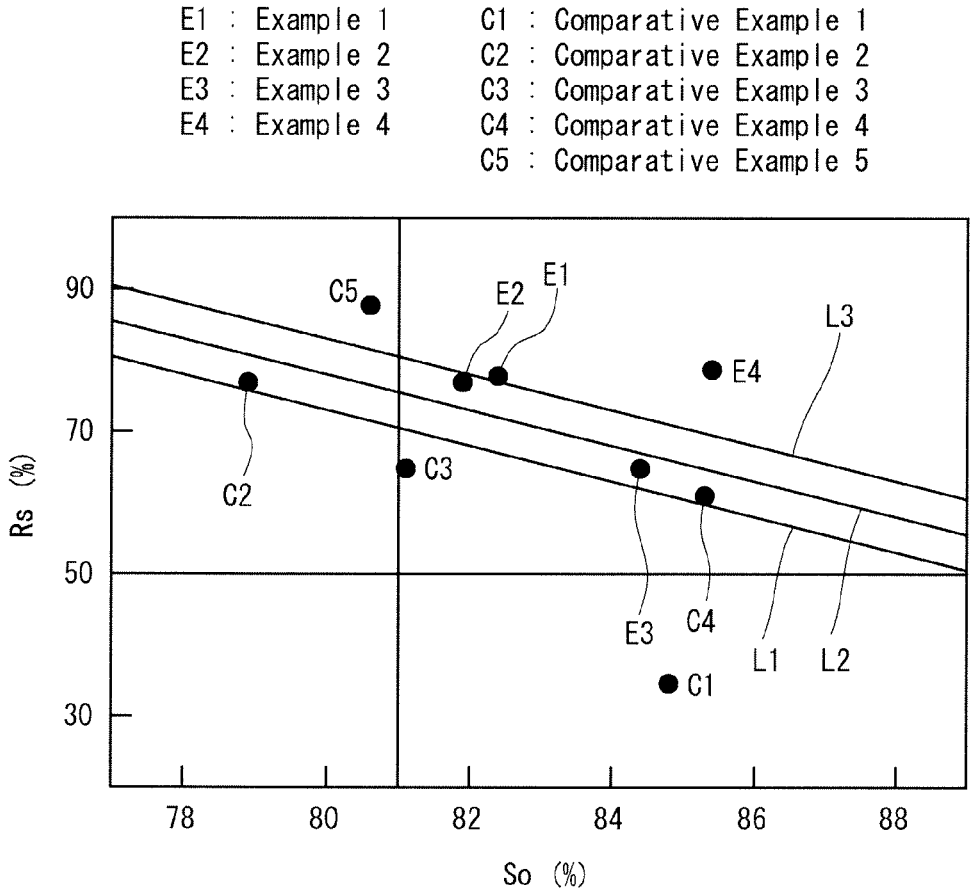
FIG. 5 is a graph showing a relationship between a ratio So and a ratio Rs.

In a graph shown in FIG. 5, the horizontal axis indicates the occupation ratio So of the dimples 18. In this graph, the vertical axis indicates the ratio Rs of the number of the dimples 18 each having a ratio Pd of not less than 9.60% and not greater than 10.37%, relative to the total number of the dimples 18. A straight line indicated by reference sign L1 in this graph is represented by the following mathematical formula.

$$Rs=-2.5*So+273$$

The golf ball 2 that is plotted in the zone above the straight line L1 in this graph satisfies the following mathematical formula (1).

$$Rs\geq-2.5*So+273 \quad (1)$$

With the golf ball 2 that satisfies the mathematical formula (1), turbulization is promoted. The golf ball 2 has excellent flight performance even though the spin rate thereof is high.

A straight line indicated by reference sign L2 in the graph of FIG. 5 is represented by the following mathematical formula.

$$Rs=-2.5*So+278$$

The golf ball 2 that is plotted in the zone above the straight line L2 in this graph satisfies the following mathematical formula (2).

$$Rs \geq -2.5*So+278 \quad (2)$$

With the golf ball 2 that satisfies the mathematical formula (2), turbulization is promoted. The golf ball 2 has excellent flight performance even though the spin rate thereof is high.

A straight line indicated by reference sign L3 in the graph of FIG. 5 is represented by the following mathematical formula.

$$Rs=-2.5*So+283$$

The golf ball 2 that is plotted in the zone above the straight line L3 in this graph satisfies the following mathematical formula (3).

$$Rs \geq -2.5*So+283 \quad (3)$$

With the golf ball 2 that satisfies the mathematical formula (3), turbulization is promoted. The golf ball 2 has excellent flight performance even though the spin rate thereof is high.

Figure 6:
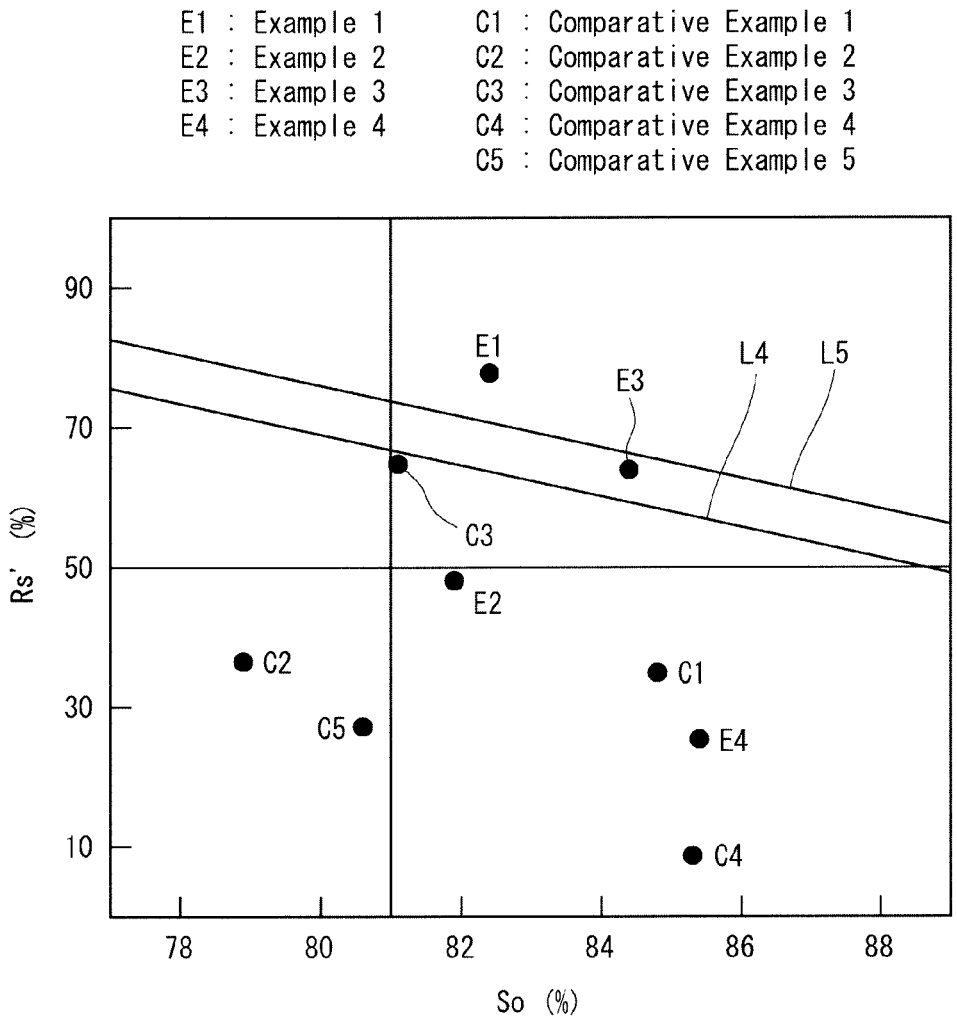
FIG. 6 is a graph showing a relationship between the ratio So and a ratio Rs'.

In a graph shown in FIG. 6, the horizontal axis indicates the occupation ratio So of the dimples 18. In this graph, the vertical axis indicates the ratio Rs' of the number of the dimples 18 each having a ratio Pd of not less than 10.10% and not greater than 10.37%, relative to the total number of the dimples 18. A straight line indicated by reference sign L4 in this graph is represented by the following mathematical formula.

$$Rs'=-2.2*So+245$$

The golf ball 2 that is plotted in the zone above the straight line L4 in this graph satisfies the following mathematical formula (4).

$$Rs' \geq -2.2*So+245 \quad (4)$$

With the golf ball 2 that satisfies the mathematical formula (4), turbulization is promoted. The golf ball 2 has excellent flight performance even though the spin rate thereof is high.

A straight line indicated by reference sign L5 in the graph of FIG. 6 is represented by the following mathematical formula.

$$Rs'=-2.2*So+252$$

The golf ball 2 that is plotted in the zone above the straight line L5 in this graph satisfies the following mathematical formula (5).

$$Rs' \geq -2.2*So+252 \quad (5)$$

With the golf ball 2 that satisfies the mathematical formula (5), turbulization is promoted. The golf ball 2 has excellent flight performance even though the spin rate thereof is high.

As shown in FIG. 3, the surface of the golf ball 2 (or the phantom sphere 22) can be divided into two hemispheres HE by an equator Eq. Specifically, the surface can be divided into a northern hemisphere NH and a southern hemisphere SH. Each hemisphere HE has a pole P. The pole P corresponds to a deepest point of a mold for the golf ball 2.

FIG. 2 shows the northern hemisphere. The southern hemisphere has a pattern obtained by rotating the dimple pattern in FIG. 2 about the pole P. Line segments S1, S2, and S3 shown in FIG. 2 each extend from the pole P. The angle at the pole P between the line segment S1 and the line segment S2 is 120°. The angle at the pole P between the line segment S2 and the line segment S3 is 120°. The angle at the pole P between the line segment S3 and the line segment S1 is 120°.

Of the surface of the golf ball 2 (or the phantom sphere 22), a zone surrounded by the line segment S1, the line segment S2, and the equator Eq is a first spherical triangle T1. Of the surface of the golf ball 2 (or the phantom sphere 22), a zone surrounded by the line segment S2, the line segment S3, and the equator Eq is a second spherical triangle T2. Of the surface of the golf ball 2 (or the phantom sphere 22), a zone surrounded by the line segment S3, the line segment S1, and the equator Eq is a third spherical triangle T3. Each spherical triangle is a unit. The hemisphere HE can be divided into the three units.

When the dimple pattern of the first spherical triangle T1 is rotated by 120° about a straight line connecting the two poles P, the resultant dimple pattern substantially overlaps the dimple pattern of the second spherical triangle T2. When the dimple pattern of the second spherical triangle T2 is rotated by 120° about the straight line connecting the two poles P, the resultant dimple pattern substantially overlaps the dimple pattern of the third spherical triangle T3. When the dimple pattern of the third spherical triangle T3 is rotated by 120° about the straight line connecting the two poles P, the resultant dimple pattern substantially overlaps the dimple pattern of the first spherical triangle T1. In other words, the dimple pattern of the hemisphere is composed of three units that are rotationally symmetrical to each other.

A pattern obtained by rotating the dimple pattern of each hemisphere HE by 120° about the straight line connecting the two poles P substantially overlaps the dimple pattern that has not been rotated. The dimple pattern of each hemisphere HE has 120° rotational symmetry.

A line segment S4 shown in FIG. 2 extends from the pole P. The angle at the pole P between the line segment S4 and the line segment S1 is 60°. The angle at the pole P between the line segment S4 and the line segment S2 is 60°. The first spherical triangle T1 (unit) can be divided into a small spherical triangle T1*a* and another small spherical triangle T1*b* by the line segment S4. The spherical triangle T1*a* and the spherical triangle T1*b* are small units.

A pattern obtained by inverting the dimple pattern of the spherical triangle T1*a* with respect to a plane containing the line segment S4 and the straight line connecting both poles P substantially overlaps the dimple pattern of the spherical triangle T1*b*. In other words, the dimple pattern of each unit is composed of two small units that are mirror-symmetrical to each other.

Similarly, the dimple pattern of the second spherical triangle T2 is also composed of two small units that are mirror-symmetrical to each other. The dimple pattern of the third spherical triangle T3 is also composed of two small units that are mirror-symmetrical to each other. The dimple pattern of the hemisphere HE is composed of the six small units.

According to the findings by the present inventor, with the golf ball 2 of which the dimple pattern of each hemisphere is composed of three units that are rotationally symmetrical to each other by 120° and the dimple pattern of each unit is composed of two small units that are mirror-symmetrical to each other, turbulization is promoted. The golf ball 2 has excellent flight performance even though the spin rate thereof is high.

EXAMPLES

[Preparation of Polyol Composition]

[Polyol composition #1 (Urethane Polyol)]

Polytetramethylene ether glycol (PTMG, number average molecular weight: 650) and trimethylol propane (TMP) were dissolved in a solvent (toluene and methyl ethyl ketone). The mole ratio (PTMG:TMP) was 1.8:1.0. Dibutyltin dilaurate was added to this solution as a catalyst in an amount of 0.1% by weight with respect to the entire base material. While this polyol solution was kept at 80° C., isophorone diisocyanate (IPDI) was dropped and mixed into the polyol solution. The mole ratio (NCO/OH) of this mixture solution was 0.6. After the dropping, the mixture solution was continuously agitated until isocyanate was eliminated. Thereafter, the mixture solution was cooled at normal temperature to obtain a urethane polyol composition. The details of this composition are as follows.

Solid content: 30% by weight

Content of PTMG: 67% by weight

Hydroxyl value of solid content: 67.4 mg KOH/g

OH amount of solid content: 1.20 mmol/g

OH amount of composition: 0.36 mmol/g

Weight average molecular weight of urethane polyol: 4867

[Polyol Composition #2 (Urethane Polyol)]

Polytetramethylene ether glycol (PTMG, number average molecular weight: 1000) and trimethylol propane (TMP) were dissolved in a solvent (toluene and methyl ethyl ketone). The mole ratio (PTMG:TMP) was 1.8:1.0. Dibutyltin dilaurate was added to this solution as a catalyst in an amount of 0.1% by weight with respect to the entire base material. While this polyol solution was kept at 80° C., isophorone diisocyanate (IPDI) was dropped and mixed into the polyol solution. The mole ratio (NCO/OH) of this mixture solution was 0.6. After the dropping, the mixture solution was continuously agitated until isocyanate was eliminated. Thereafter, the mixture solution was cooled at normal temperature to obtain a urethane polyol composition. The details of this composition are as follows.

Solid content: 30% by weight

Content of PTMG: 76% by weight

Hydroxyl value of solid content: 49.5 mg KOH/g

OH amount of solid content: 0.88 mmol/g

OH amount of composition: 0.26 mmol/g

Weight average molecular weight of urethane polyol: 6624

[Polyol Composition #3 (Polyrotaxane Composition)]

A polyol composition was prepared by mixing 50 parts by weight of a polyrotaxane in which at least a part of the hydroxyl groups of each cyclodextrin is modified with a caprolactone chain via a —O—$C_3H_6$—O— group (the aforementioned "SeRM Super Polymer", linear molecule: polyethylene glycol, blocking group: adamantane group, molecular weight of linear molecule: 35,000, hydroxyl value: 72 mg KOH/g, weight average molecular weight: 700,000), 28 parts by weight of a polycaprolactone polyol (trade name "Placcel 308", manufactured by Daicel Corporation, hydroxyl value: 190 to 200 mg KOH/g), 22 parts by weight of a vinyl chloride-vinyl acetate-vinyl alcohol copolymer (the aforementioned "Solbin AL", hydroxyl value: 63.4 mg KOH/g), 0.1 parts by weight of a modified silicone (trade name "DBL-C31", manufactured by Gelest, Inc.), 0.01 parts by weight of dibutyltin dilaurate, and 100 parts by weight of a solvent (xylene/methyl ethyl ketone, weight ratio: 70/30).

[Preparation of Polyisocyanate Composition]

[Polyisocyanate Composition #1]

Mixed were 30 parts by weight of an isocyanurate-modified product of hexamethylene diisocyanate (trade name "DURANATE TKA-100", manufactured by Asahi Kasei Chemicals Corporation, NCO content: 21.7% by weight), 30 parts by weight of a biuret-modified product of hexamethylene diisocyanate (trade name "DURANATE 21S-75E", manufactured by Asahi Kasei Chemicals Corporation, NCO content: 15.5% by weight), and 40 parts by weight of an isocyanurate-modified product of isophorone diisocyanate (trade name "Desmodur Z 4470", manufactured by Sumika Bayer Urethane CO., Ltd., NCO content: 11.9% by weight). A mixed solvent of methyl ethyl ketone, n-butyl acetate, and toluene was added as a solvent to this mixture to obtain a polyisocyanate composition. The concentration of the polyisocyanate component in the composition was 60% by weight.

[Polyisocyanate Composition #2]

100 parts by weight of a biuret-modified product of hexamethylene diisocyanate (the aforementioned "DURANATE 21S-75E", NCO content: 15.5% by weight) and 100 parts by weight of methyl ethyl ketone were mixed to obtain a polyisocyanate composition.

Example 1

A rubber composition was obtained by kneading 100 parts by weight of a high-cis polybutadiene (trade name "BR-730", manufactured by JSR Corporation), 29.5 parts by weight of zinc diacrylate, 5 parts by weight of zinc oxide, an appropriate amount of barium sulfate, 0.5 parts by weight of diphenyl disulfide, and 0.9 parts by weight of dicumyl peroxide. This rubber composition was placed into a mold including upper and lower mold halves each having a hemispherical cavity, and heated at 170° C. for 20 minutes to obtain a core with a diameter of 39.7 mm. The amount of barium sulfate was adjusted such that a core having a predetermined weight was obtained.

A resin composition was obtained by kneading 55 parts by weight of an ionomer resin (trade name "Surlyn 8945", manufactured by E.I. du Pont de Nemours and Company), 45 parts by weight of another ionomer resin (trade name "Himilan AM7329", manufactured by Du Pont-MITSUI POLYCHEMICALS Co., Ltd.), and 4 parts by weight of titanium dioxide with a twin-screw kneading extruder. The core was covered with the resin composition by injection molding to form a mid layer with a thickness of 1.0 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with a spray gun, and kept at 23° C. for 12 hours to obtain a reinforcing layer with a thickness of 10 μm.

A resin composition was obtained by kneading 100 parts by weight of a thermoplastic polyurethane elastomer (trade name "Elastollan XNY83A", manufactured by BASF Japan Ltd.), 4 parts by weight titanium dioxide, and 0.08 parts by weight of ultramarine blue with a twin-screw kneading extruder. Half shells were obtained from this resin composition by compression molding. The sphere consisting of the core, the mid layer, and the reinforcing layer was covered with two of these half shells. These half shells and the sphere were placed into a final mold that includes upper and lower mold halves each having a hemispherical cavity and having a large number of pimples on its cavity face, and a cover was obtained by compression molding. The thickness of the cover was 0.5 mm. Dimples having a shape that is the inverted shape of the pimples were formed on the cover.

A paint P4 was prepared by mixing 100.0 parts by weight of the polyol composition #1 and 29.0 parts by weight of the polyisocyanate composition #1. The cover was coated with the paint P4. The paint P4 was dried at 50° C. for 12 hours to obtain an inner layer.

A paint P6 was prepared by mixing 100.0 parts by weight of the polyol composition #2 and 19.2 parts by weight of the polyisocyanate composition #1. The inner layer was coated with the paint P6. The paint P6 was dried at 50° C. for 12 hours to obtain an outer layer. A golf ball having this outer layer had a diameter of about 42.7 mm and a weight of about 45.6 g. Specifications D1 of the dimples after the coating are shown in detail in Tables 3 and 5 below.

Examples 2 to 4 and Comparative Examples 1 to 3

Golf balls of Examples 2 to 4 and Comparative Examples 1 to 3 were obtained in the same manner as Example 1, except the specifications of the dimples were as shown in Tables 7 and 8 below. The specifications of the dimples are shown in detail in Tables 3 to 6 below. In each golf ball, the dimple pattern of each hemisphere is composed of three units that are rotationally symmetrical to each other. The dimple pattern of each unit is composed of two small units that are mirror-symmetrical to each other. The number of the small units in each hemisphere is six.

Comparative Examples 4 and 5

Golf balls of Comparative Examples 4 and 5 were obtained in the same manner as Example 1, except the specifications of the dimples were as shown in Table 8 below. The specifications of the dimples are shown in detail in Tables 4 and 6 below. The dimple pattern of the golf ball according to Comparative Example 4 is the same as the dimple pattern of the golf ball according to Example 1 in JP2013-153966. The dimple pattern of each hemisphere of the golf ball according to Comparative Example 4 does not have rotational symmetry. The dimple pattern of the golf ball according to Comparative Example 5 is the same as the dimple pattern of the golf ball according to Comparative Example 1 in JP2013-153966. The dimple pattern of each hemisphere of the golf ball according to Comparative Example 5 does not have rotational symmetry.

Examples 5 to 10 and Comparative Examples 6 to 10

Golf balls of Examples 5 to 10 and Comparative Examples 6 to 10 were obtained in the same manner as Example 1, except the specifications of the paint film were as shown in Tables 9 to 11 below. The specifications of the paint film are shown in detail in Tables 1 and 2 below.

Example 11

A rubber composition was obtained by kneading 100 parts by weight of a high-cis polybutadiene (the aforementioned "BR-730"), 35 parts by weight of magnesium acrylate, 28 parts by weight of methacrylic acid, an appropriate amount of barium sulfate, and 1.3 parts by weight of dicumyl peroxide. This rubber composition was placed into a mold including upper and lower mold halves each having a hemispherical cavity, and heated at 160° C. for 20 minutes to obtain a center with a diameter of 24.0 mm. The amount of barium sulfate was adjusted such that a center having a predetermined weight was obtained.

A rubber composition was obtained by kneading 100 parts by weight of a high-cis polybutadiene (the aforementioned "BR-730"), 32.5 parts by weight of zinc diacrylate, 5 parts by weight of zinc oxide, an appropriate amount of barium sulfate, 0.5 parts by weight of diphenyl disulfide, and 0.9 parts by weight of dicumyl peroxide. Half shells were formed from this rubber composition. The center was covered with two of the half shells. The center and the half shells were placed into a mold including upper and lower mold halves each having a hemispherical cavity, and heated at 160° C. for 20 minutes to obtain a core with a diameter of 39.7 mm. The amount of barium sulfate was adjusted such that a core having a predetermined weight was obtained.

A resin composition was obtained by kneading 55 parts by weight of an ionomer resin (the aforementioned "Surlyn 8945"), 45 parts by weight of another ionomer resin (the aforementioned "Himilan AM7329"), and 4 parts by weight titanium dioxide with a twin-screw kneading extruder. The core was covered with the resin composition by injection molding to form a mid layer with a thickness of 1.0 mm.

A paint composition (the aforementioned "POLIN 750LE") including a two-component curing type epoxy resin as a base polymer was prepared. The base material liquid of this paint composition includes 30 parts by weight of a bisphenol A type epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with a spray gun, and kept at 23° C. for 12 hours to obtain a reinforcing layer with a thickness of 10 μm.

A resin composition was obtained by kneading 100 parts by weight of a thermoplastic polyurethane elastomer (the aforementioned "Elastollan XNY83A", manufactured by BASF Japan Ltd.), 4 parts by weight titanium dioxide, and 0.08 parts by weight of ultramarine blue with a twin-screw kneading extruder. Half shells were obtained from this resin composition by compression molding. The sphere consisting of the core, the mid layer, and the reinforcing layer was covered with two of these half shells. These half shells and the sphere were placed into a final mold that includes upper and lower mold halves each having a hemispherical cavity and having a large number of pimples on its cavity face, and a cover was obtained by compression molding. The thickness of the cover was 0.5 mm. Dimples having a shape that is the inverted shape of the pimples were formed on the cover.

A paint P4 was prepared by mixing 100.0 parts by weight of the polyol composition #1 and 29.0 parts by weight of the polyisocyanate composition #1. The cover was coated with the paint P4. The paint P4 was dried at 50° C. for 12 hours to obtain an inner layer.

A paint P6 was prepared by mixing 100.0 parts by weight of the polyol composition #2 and 19.2 parts by weight of the polyisocyanate composition #1. The inner layer was coated with the paint P6. The paint P6 was dried at 50° C. for 12 hours to obtain an outer layer. A golf ball having this outer layer had a diameter of about 42.7 mm and a weight of about 45.6 g. Specifications D1 of the dimples after the coating are shown in detail in Tables 3 and 5 below.

Comparative Examples 11 and 12

A golf ball of Comparative Example 11 was obtained in the same manner as Example 11, except the specifications of the inner layer were as shown in Table 11 below. A golf ball of Comparative Example 12 was obtained in the same manner as Example 11, except the specifications of the dimples were as shown in Table 11 below.

[Coefficient of Friction]

Figure 30:
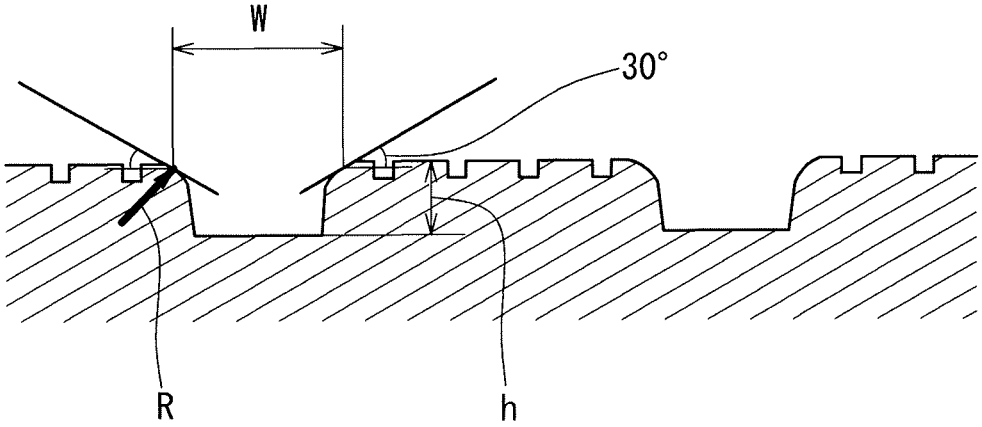
FIG. 30 is an enlarged cross-sectional view showing a part of a collisional surface of the collisional body shown in FIG. 28.
Figure 31:
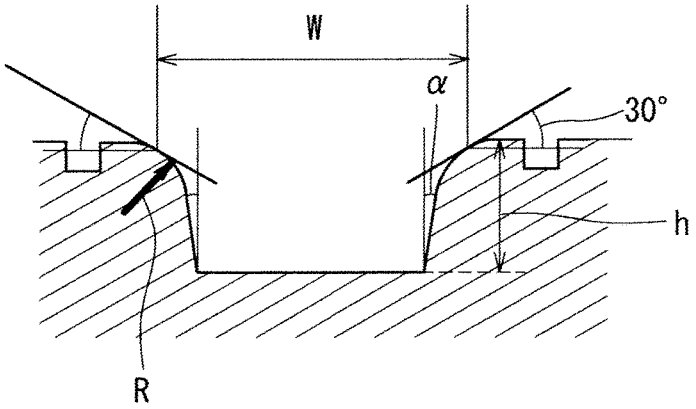
FIG. 31 is an enlarged cross-sectional view showing a part of the collisional surface in FIG. 30.

The contact force tester shown in FIG. 27 was prepared. The grooves of a wedge (trade name "CG15") manufactured by Cleveland Golf Company, Inc. are reproduced on the collisional surface of the contact force tester. A part of the collisional surface is shown in FIGS. 30 and 31. The collisional surface has a plurality of zip grooves (large grooves). These zip grooves extend parallel to each other. A plurality of small grooves are provided between the zip groove and the zip groove adjacent thereto. The specifications of the zip grooves are as follows.

Width W: 0.70 mm

Depth h: 0.50 mm

Pitch: 3.56 mm

Angle α: 10°

Curvature radius R of shoulder: 0.25 mm

The small grooves are formed by laser milling. At the surface portion between the zip grooves, a surface roughness Ra is 2.40±0.8 μm, and Rmax is 14.0±8 μm. The surface roughness Ra and Rmax are measured with a surface roughness meter (trade name "SJ-301") manufactured by Mitutoyo Corporation. The measurement conditions are as follows.

Measurement length: 2.5 mm

Cut-off value: 2.5 mm

With the contact force tester, the coefficient of friction of a golf ball was measured. The measurement temperature was 23° C., and the ball initial speed was 19 m/s. The measurement was conducted in a dry state and in a wet state. In the measurement in a dry state, a golf ball and the collisional surface were not wet with water. In a wet state, water was applied to a golf ball and the collisional surface. Contact forces Fn(t) and Ft(t) were measured, and the maximum value of Ft(t)/Fn(t) was calculated. Twelves measurements were conducted, and the results thereof were averaged.

Figure 32:
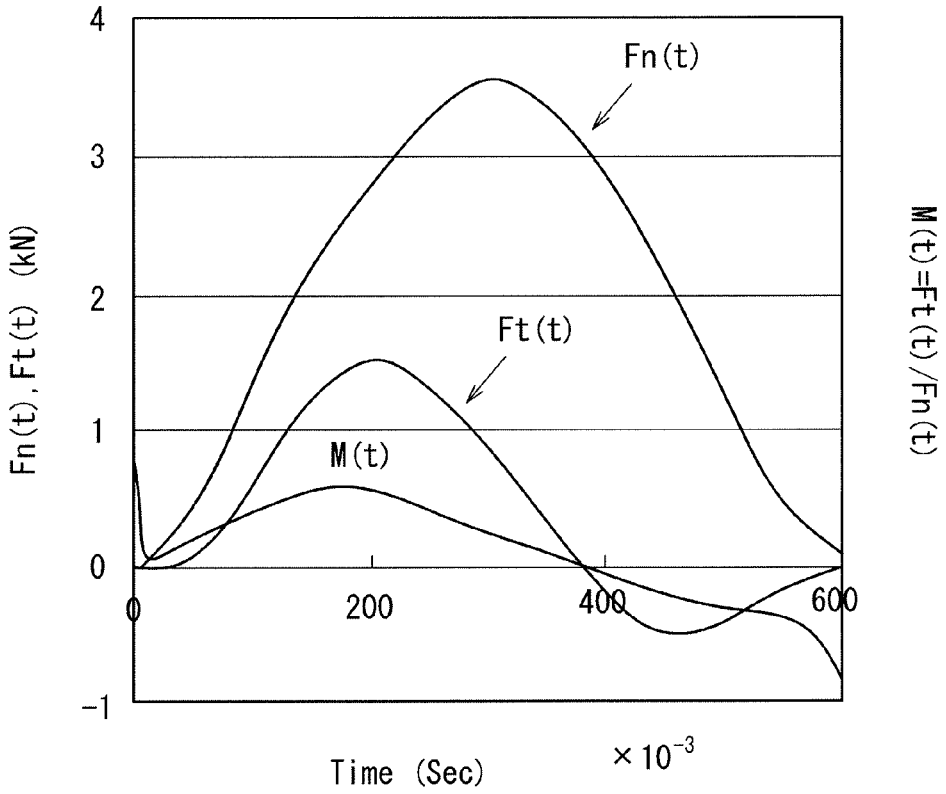
FIG. 32 is a graph showing an example of the results obtained by measurement with the contact force tester in FIG. 27.

One example of the measurement results of the contact forces Fn(t) and Ft(t) is shown in FIG. 32. The value of M(t) is calculated as Ft(t)/Fn(t). In the example of FIG. 32, the maximum value of M(t) is 0.58. Regarding the contact forces Ft and Fn, noise is likely to occur at the initial stage (when contact starts). Furthermore, regarding the contact forces Ft and Fn, noise is likely to occur also at the end stage (when contact ends). Therefore, the values at the initial stage and the end stage are trimmed, and the maximum value of M(t) is calculated.

Simultaneously with the measurement of the coefficient of friction, a spin rate was measured with the stroboscopes and the cameras. Furthermore, a spin ratio was calculated. The spin ratio is the ratio of a spin rate in a wet state relative to a spin rate in a dry state. These results are shown in Tables 7 to 11 below.

[Feel at Impact]

Ten golf players hit golf balls with wedges (trade name "CG15 Forged Wedge", manufactured by Cleveland Golf Company, Inc., loft angle:)52° and were asked about feel at impact. The evaluation was categorized as follows on the basis of the number of golf players who answered, "the feel at impact was good".

A: 8 persons or more

B: 4 to 7 persons

C: 3 persons or less

The results are shown in Tables 7 to 11 below.

[Flight Test]

A driver (trade name "XXIO9", manufactured by DUNLOP SPORTS CO. LTD., shaft hardness: S, loft angle:)9.5° was attached to a swing machine manufactured by Golf Laboratories, Inc. A golf ball was hit under a condition of a head speed of 50 m/sec, and the ball speed, the spin rate, and the flight distance were measured. The flight distance is the distance between the point at the hit and the point at which the ball stopped. The average value of data obtained by 12 measurements is shown in Tables 7 to 11 below.

TABLE 1

Specifications of Paint (parts by weight)

| | P1 | P2 | P3 | P4 |
|---|---|---|---|---|
| Polyol composition #1 | 100.0 | 100.0 | 100.0 | 100.0 |
| Polyol composition #2 | — | — | — | — |
| Polyol composition #3 | — | — | — | — |
| Polyisocyanate composition #1 | 9.2 | 17.0 | 24.0 | 29.0 |
| Polyisocyanate composition #2 | — | — | — | — |
| Mole ratio (NCO/OH) | 0.38/1.0 | 0.7/1.0 | 1.0/1.0 | 1.2/1.0 |
| M10 (kgf/cm$^2$) | 7.9 | 100.0 | 150.0 | 186.4 |
| M50 (kgf/cm$^2$) | 14.3 | 118.5 | 178.8 | 209.4 |
| M100 (kgf/cm$^2$) | 21.9 | 161.1 | 240.0 | 278.6 |
| Mmax (kgf/cm$^2$) | 119.8 | 195.0 | 276.7 | 337.1 |
| Maximum elongation (%) | 260.5 | 140.0 | 114.5 | 120.7 |

TABLE 2

Specifications of Paint (parts by weight)

| | P5 | P6 | P7 |
|---|---|---|---|
| Polyol composition #1 | 100.0 | — | — |
| Polyol composition #2 | — | 100.0 | — |
| Polyol composition #3 | — | — | 100.0 |
| Polyisocyanate composition #1 | 38.6 | 19.2 | — |
| Polyisocyanate composition #2 | — | — | 17.0 |
| Mole ratio (NCO/OH) | 1.6/1.0 | 1.04/1.0 | 1.03/1.0 |
| M10 (kgf/cm$^2$) | 274.9 | 75.0 | 8.2 |
| M50 (kgf/cm$^2$) | 250.6 | 110.0 | 32.4 |
| M100 (kgf/cm$^2$) | — | 163.0 | — |
| Mmax (kgf/cm$^2$) | 293.3 | 416.0 | 40.2 |
| Maximum elongation (%) | 76.4 | 196.0 | 51.4 |

TABLE 3

Specifications of Dimples

| | | Num. | Dm (mm) | Dp2 (mm) | Dp1 (mm) | R (mm) | Volume (mm$^3$) | Pd (%) |
|---|---|---|---|---|---|---|---|---|
| D1 | A | 24 | 4.60 | 0.135 | 0.2592 | 19.66 | 1.123 | 10.77 |
| | B | 12 | 4.50 | 0.135 | 0.2539 | 18.82 | 1.075 | 10.54 |
| | C | 252 | 4.35 | 0.135 | 0.2461 | 17.59 | 1.004 | 10.19 |
| | D | 24 | 4.00 | 0.135 | 0.2289 | 14.88 | 0.850 | 9.37 |
| | E | 12 | 3.00 | 0.135 | 0.1878 | 8.40 | 0.478 | 7.03 |
| D2 | A | 30 | 4.70 | 0.135 | 0.2647 | 20.52 | 1.172 | 11.01 |
| | B | 30 | 4.60 | 0.135 | 0.2592 | 19.66 | 1.123 | 10.77 |
| | C | 150 | 4.40 | 0.135 | 0.2487 | 17.99 | 1.028 | 10.30 |
| | D | 90 | 4.30 | 0.135 | 0.2435 | 17.19 | 0.982 | 10.07 |
| | E | 12 | 3.00 | 0.135 | 0.1878 | 8.40 | 0.478 | 7.03 |
| D3 | A | 24 | 4.60 | 0.135 | 0.2592 | 19.66 | 1.123 | 10.77 |
| | B | 54 | 4.50 | 0.135 | 0.2539 | 18.82 | 1.075 | 10.54 |

TABLE 3-continued

| | | Specifications of Dimples | | | | | | |
|---|---|---|---|---|---|---|---|---|
| | | Num. | Dm (mm) | Dp2 (mm) | Dp1 (mm) | R (mm) | Volume ($mm^3$) | Pd (%) |
| | C | 210 | 4.40 | 0.135 | 0.2487 | 17.99 | 1.028 | 10.30 |
| | D | 24 | 4.00 | 0.135 | 0.2289 | 14.88 | 0.850 | 9.37 |
| | E | 12 | 3.00 | 0.135 | 0.1878 | 8.40 | 0.478 | 7.03 |
| D4 | A | 12 | 4.60 | 0.135 | 0.2592 | 19.66 | 1.123 | 10.77 |
| | B | 48 | 4.50 | 0.135 | 0.2539 | 18.82 | 1.075 | 10.54 |
| | C | 86 | 4.40 | 0.135 | 0.2487 | 17.99 | 1.028 | 10.30 |
| | D | 60 | 4.30 | 0.135 | 0.2435 | 17.19 | 0.982 | 10.07 |
| | E | 120 | 4.20 | 0.135 | 0.2385 | 16.40 | 0.936 | 9.84 |
| | F | 12 | 3.05 | 0.135 | 0.1895 | 8.68 | 0.494 | 7.14 |

TABLE 4

| | | Specifications of Dimples | | | | | | |
|---|---|---|---|---|---|---|---|---|
| | | Num. | Dm (mm) | Dp2 (mm) | Dp1 (mm) | R (mm) | Volume ($mm^3$) | Pd (%) |
| D5 | A | 108 | 4.60 | 0.135 | 0.2592 | 19.66 | 1.123 | 10.77 |
| | B | 84 | 4.50 | 0.135 | 0.2539 | 18.82 | 1.075 | 10.54 |
| | C | 108 | 4.40 | 0.135 | 0.2487 | 17.99 | 1.028 | 10.30 |
| | D | 12 | 3.00 | 0.135 | 0.1878 | 8.40 | 0.478 | 7.03 |
| D6 | A | 30 | 4.70 | 0.135 | 0.2647 | 20.52 | 1.172 | 11.01 |
| | B | 18 | 4.65 | 0.135 | 0.2620 | 20.09 | 1.148 | 10.89 |
| | C | 48 | 4.40 | 0.135 | 0.2487 | 17.99 | 1.028 | 10.30 |
| | D | 66 | 4.35 | 0.135 | 0.2461 | 17.59 | 1.004 | 10.19 |
| | E | 126 | 4.20 | 1.135 | 1.2385 | 2.51 | 8.628 | 9.84 |
| | F | 12 | 4.00 | 2.135 | 2.2289 | 2.00 | 18.510 | 9.37 |
| | G | 12 | 3.00 | 3.135 | 3.1878 | 1.93 | 27.213 | 7.03 |
| D7 | A | 24 | 4.60 | 0.135 | 0.2592 | 19.66 | 1.123 | 10.77 |
| | B | 12 | 4.50 | 0.135 | 0.2539 | 18.82 | 1.075 | 10.54 |
| | C | 210 | 4.35 | 0.135 | 0.2461 | 17.59 | 1.004 | 10.19 |
| | D | 66 | 4.05 | 0.135 | 0.2313 | 15.26 | 0.871 | 9.48 |
| | E | 12 | 3.00 | 0.135 | 0.1878 | 8.40 | 0.478 | 7.03 |
| D8 | A | 16 | 4.60 | 0.135 | 0.2592 | 19.66 | 1.123 | 10.77 |
| | B | 30 | 4.50 | 0.135 | 0.2539 | 18.82 | 1.075 | 10.54 |
| | C | 30 | 4.40 | 0.135 | 0.2487 | 17.99 | 1.028 | 10.30 |
| | D | 150 | 4.30 | 0.135 | 0.2435 | 17.19 | 0.982 | 10.07 |
| | E | 30 | 4.20 | 0.135 | 0.2385 | 16.40 | 0.936 | 9.84 |
| | F | 66 | 4.10 | 0.135 | 0.2336 | 15.63 | 0.892 | 9.60 |
| | G | 10 | 3.80 | 0.135 | 0.2197 | 13.44 | 0.767 | 8.90 |
| | H | 12 | 3.40 | 0.135 | 0.2028 | 10.77 | 0.614 | 7.96 |

TABLE 4-continued

| | | Specifications of Dimples | | | | | | |
|---|---|---|---|---|---|---|---|---|
| | | Num. | Dm (mm) | Dp2 (mm) | Dp1 (mm) | R (mm) | Volume ($mm^3$) | Pd (%) |
| D9 | A | 26 | 4.50 | 0.135 | 0.2539 | 18.82 | 1.075 | 10.54 |
| | B | 88 | 4.40 | 0.135 | 0.2487 | 17.99 | 1.028 | 10.30 |
| | C | 102 | 4.30 | 0.135 | 0.2435 | 17.19 | 0.982 | 10.07 |
| | D | 94 | 4.10 | 0.135 | 0.2336 | 15.63 | 0.892 | 9.60 |
| | E | 14 | 3.60 | 0.135 | 0.2110 | 12.07 | 0.688 | 8.43 |

TABLE 5

Figure 7:
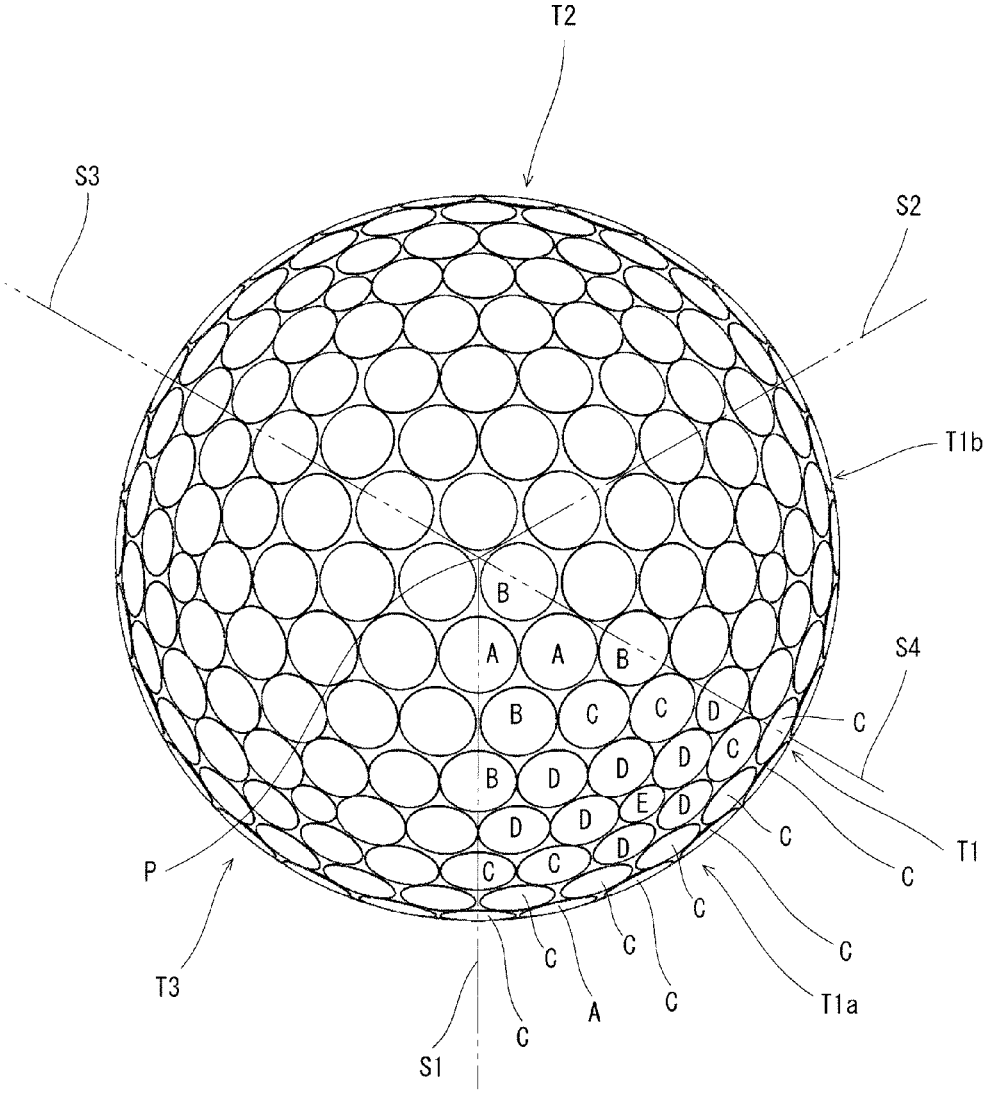
FIG. 7 is a plan view of a golf ball according to Example 2 of the present invention.
Figure 8:
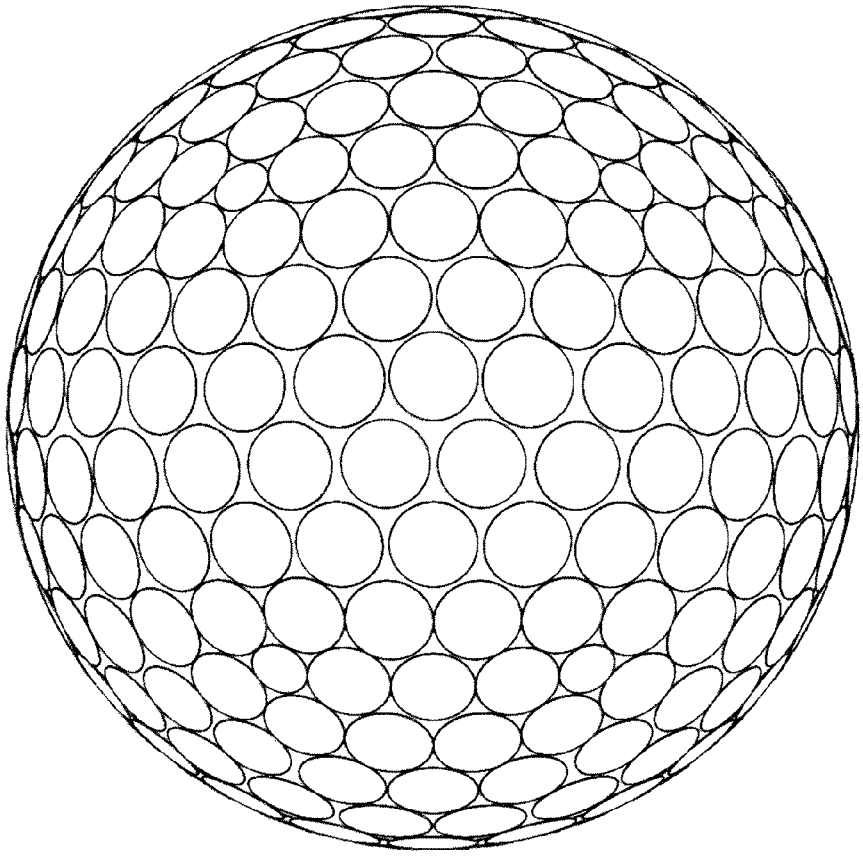
FIG. 8 is a front view of the golf ball in FIG. 7.
Figure 9:
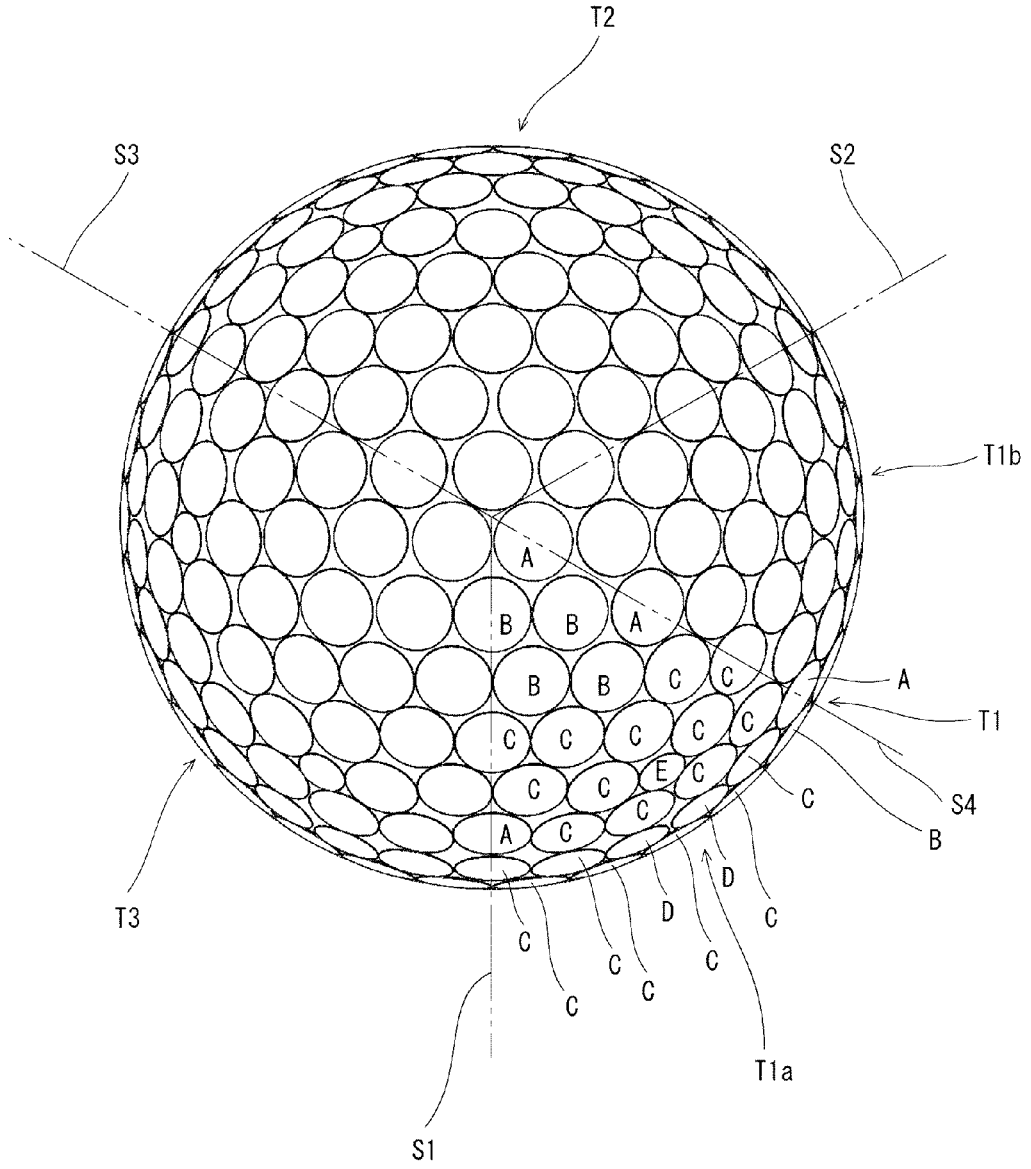
FIG. 9 is a plan view of a golf ball according to Example 3 of the present invention.
Figure 10:
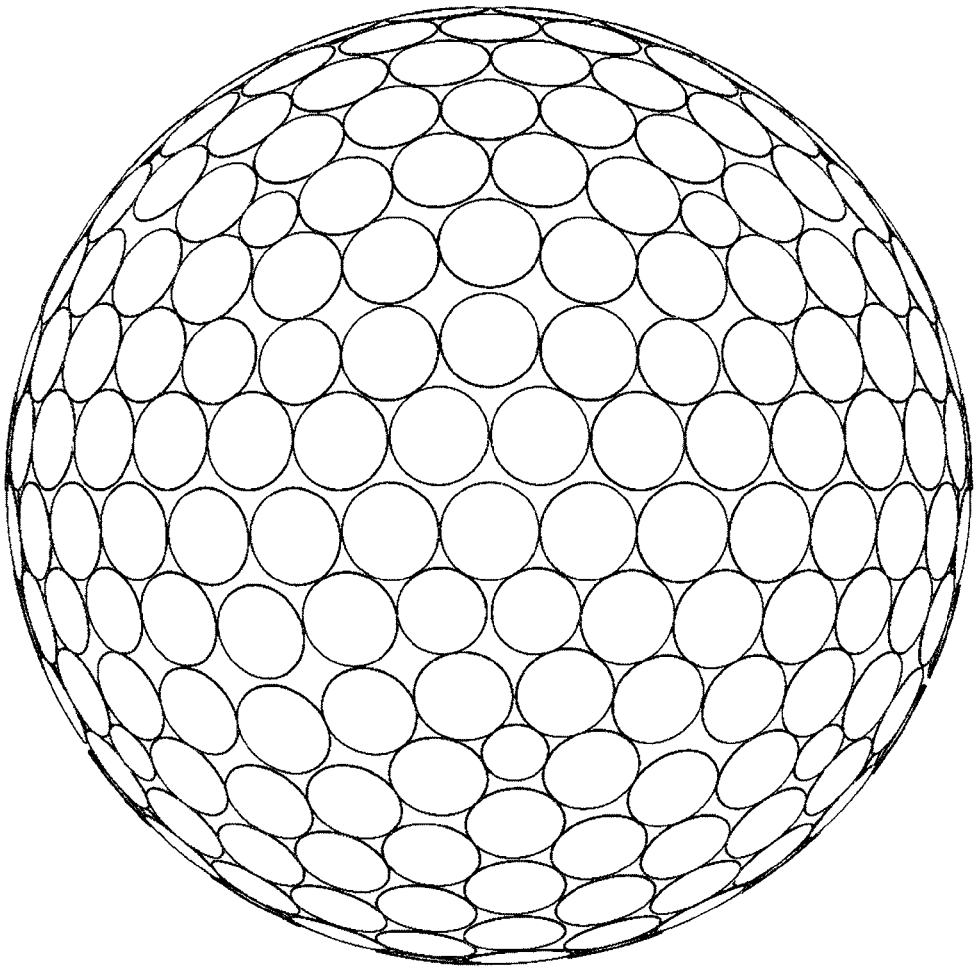
FIG. 10 is a front view of the golf ball in FIG. 9.
Figure 11:
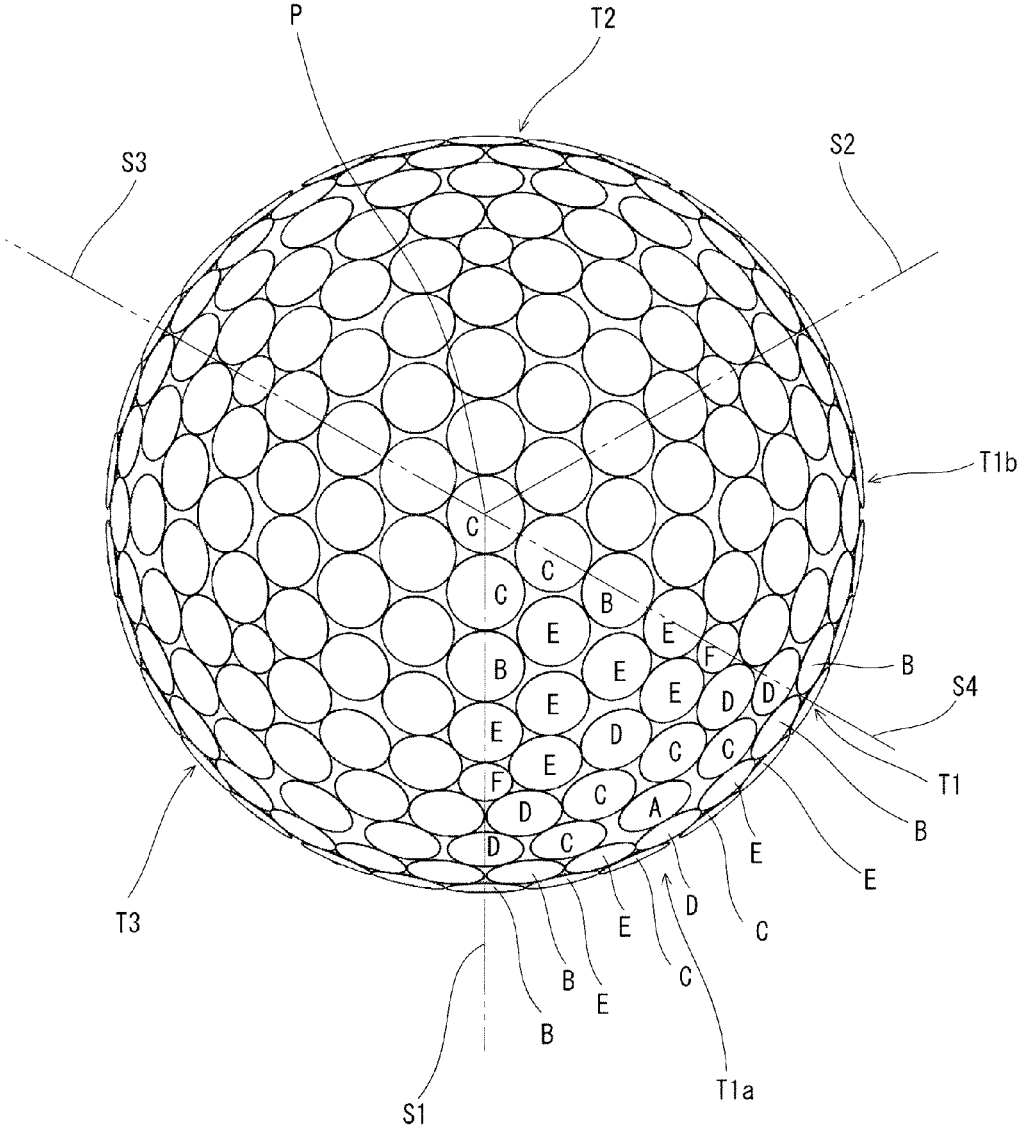
FIG. 11 is a plan view of a golf ball according to Example 4 of the present invention.
Figure 12:
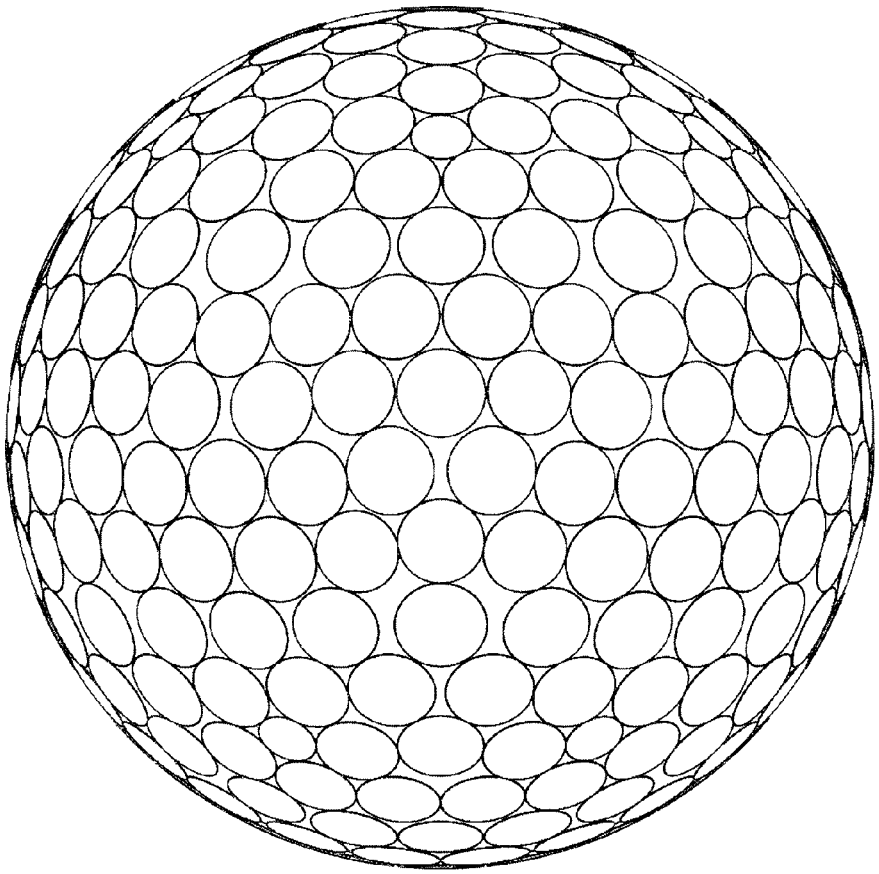
FIG. 12 is a front view of the golf ball in FIG. 11.

| Specifications of Dimples | | | | |
|---|---|---|---|---|
| | D1 | D2 | D3 | D4 |
| Plan view | FIG. 2 | FIG. 7 | FIG. 9 | FIG. 11 |
| Front view | FIG. 3 | FIG. 8 | FIG. 10 | FIG. 12 |
| Number | 324 | 312 | 324 | 338 |
| Number of units | 3 | 3 | 3 | 3 |
| Number of small units | 6 | 6 | 6 | 6 |
| So (%) | 82.4 | 81.9 | 84.4 | 85.4 |
| Rs (%) | 77.8 | 76.9 | 64.8 | 78.7 |
| Rs + 2.5 * So − 273 | 10.80 | 8.65 | 2.80 | 19.20 |
| Mathematical formula (1) | Satisfied | Satisfied | Satisfied | Satisfied |
| Rs + 2.5 * So − 278 | 5.80 | 3.65 | −2.20 | 14.20 |
| Mathematical formula (2) | Satisfied | Satisfied | Unsatisfied | Satisfied |
| Rs + 2.5 * So − 283 | 0.80 | −1.35 | −7.20 | 9.20 |
| Mathematical formula (3) | Satisfied | Unsatisfied | Unsatisfied | Satisfied |
| Rs' (%) | 77.8 | 48.1 | 64.8 | 25.4 |
| Rs' + 2.2 * So − 245 | 14.08 | −16.72 | 5.48 | −31.72 |
| Mathematical formula (4) | Satisfied | Unsatisfied | Satisfied | Unsatisfied |
| Rs' + 2.2 * So − 252 | 7.08 | −23.72 | −1.52 | −38.72 |
| Mathematical formula (5) | Satisfied | Unsatisfied | Unsatisfied | Unsatisfied |

TABLE 6

Figure 13:
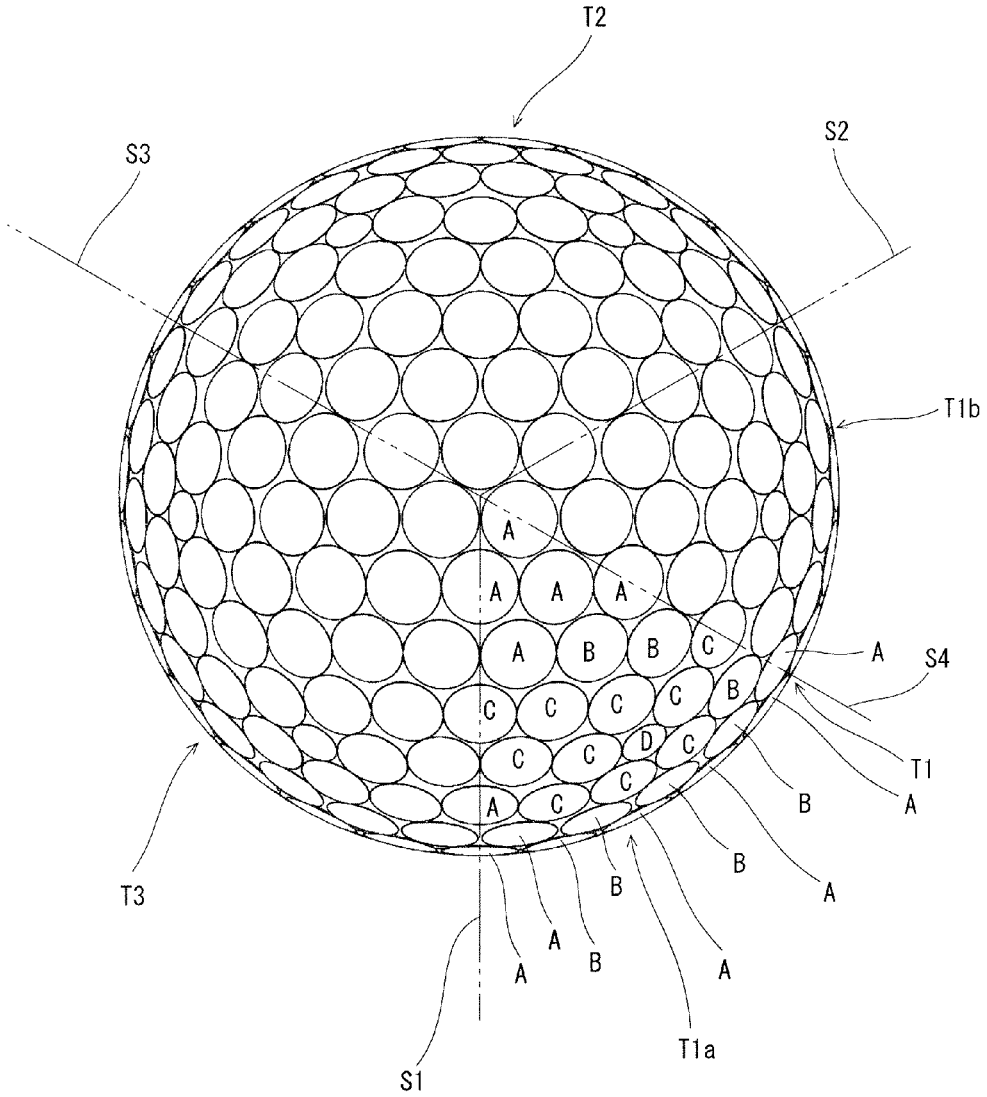
FIG. 13 is a plan view of a golf ball according to Comparative Example 1.
Figure 14:
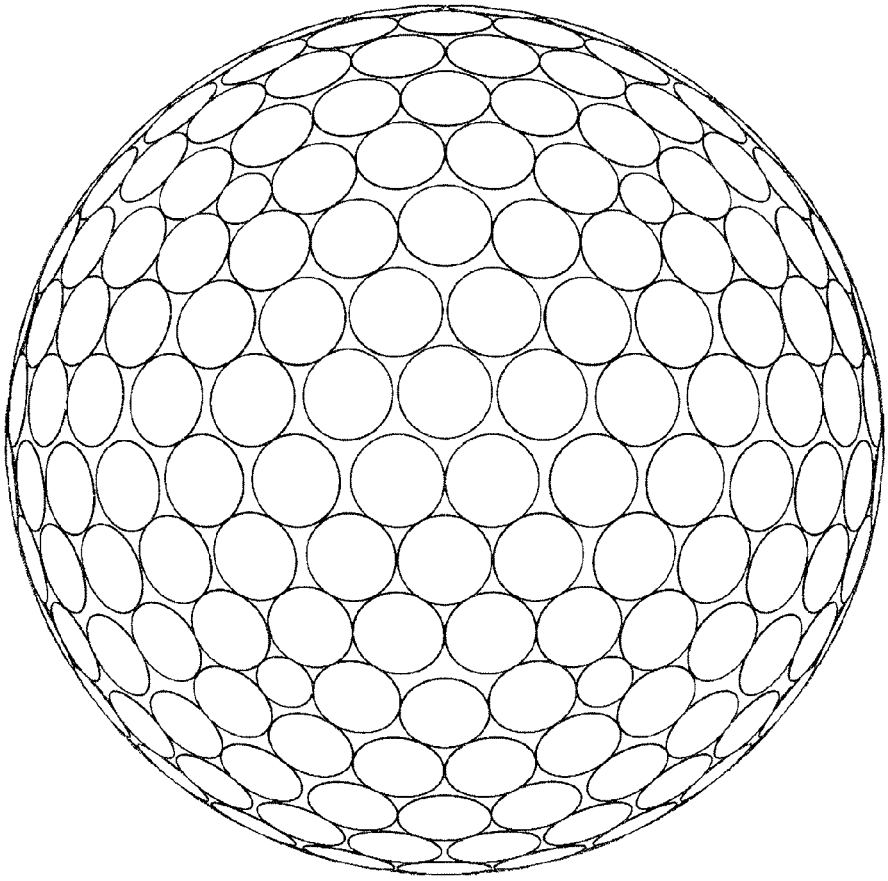
FIG. 14 is a front view of the golf ball in FIG. 13.
Figure 15:
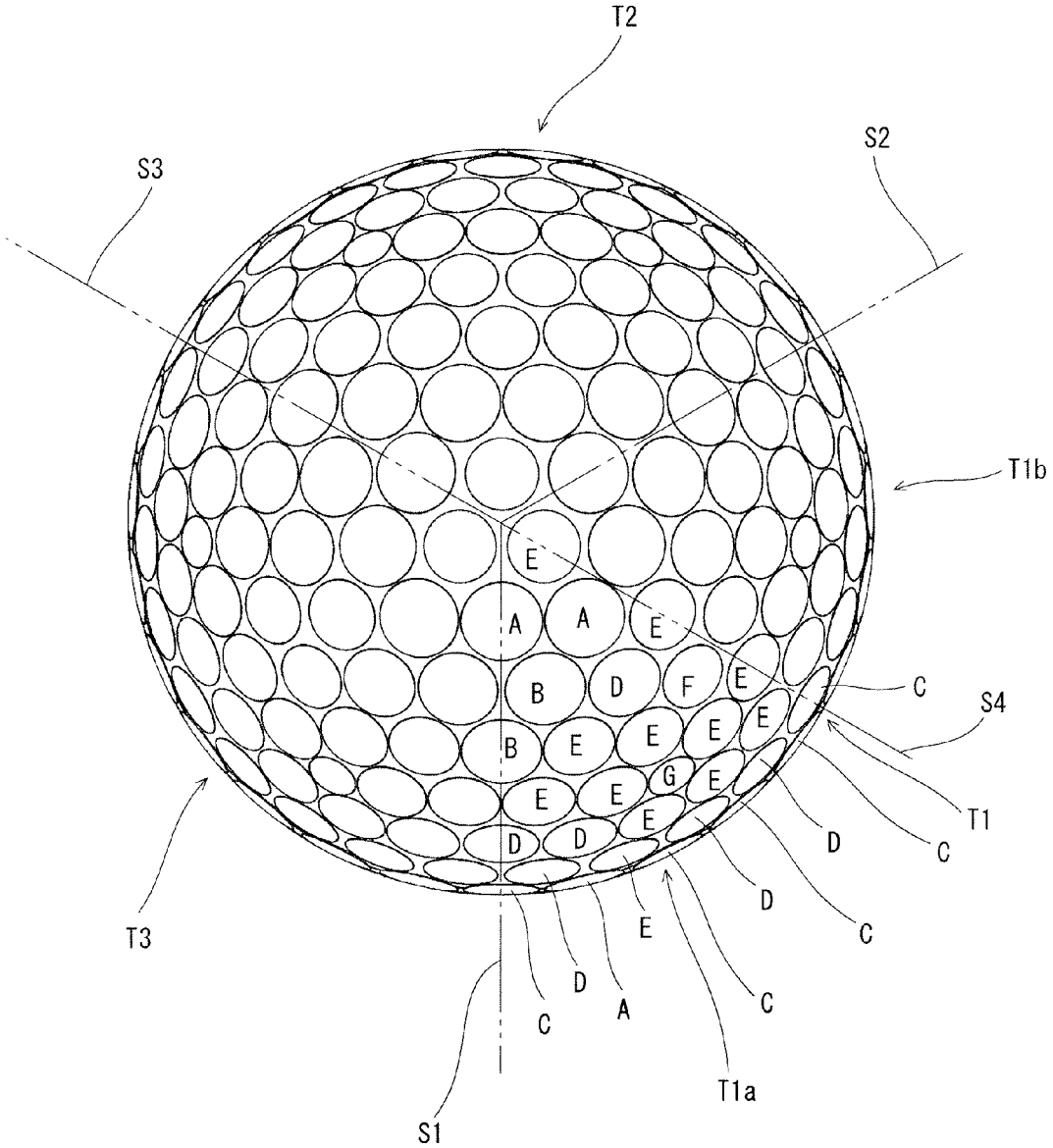
FIG. 15 is a plan view of a golf ball according to Comparative Example 2.
Figure 16:
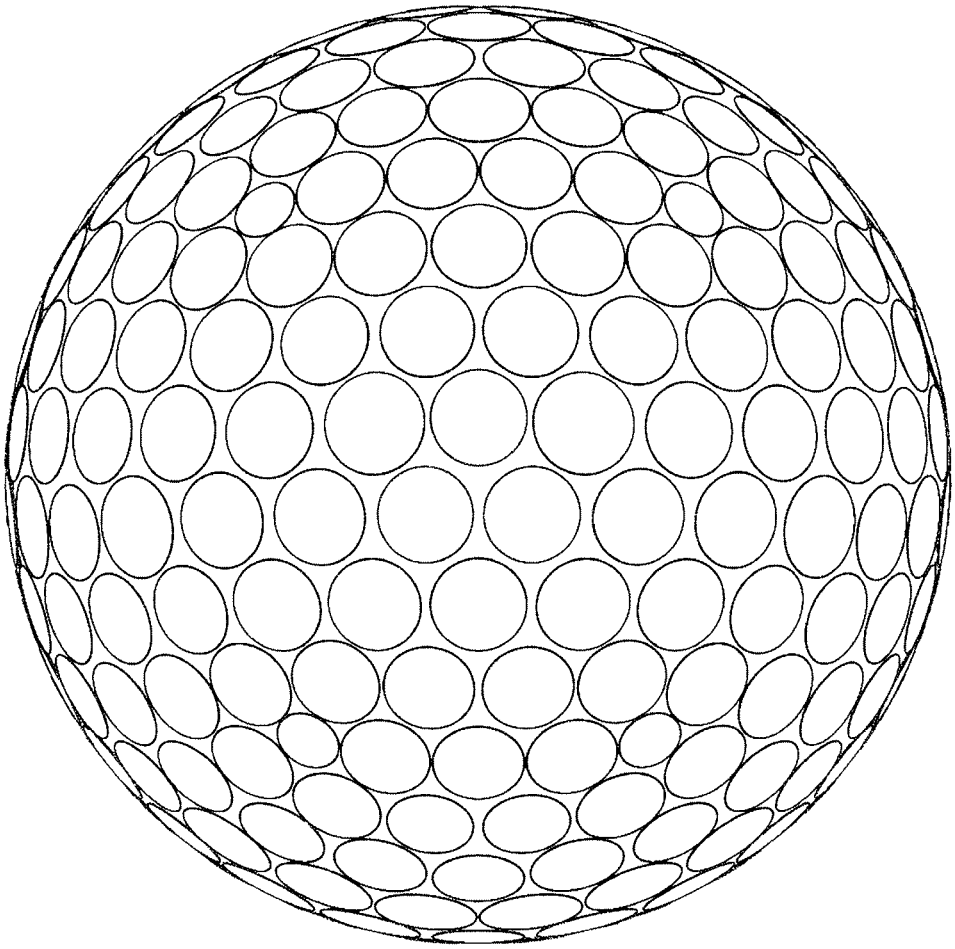
FIG. 16 is a front view of the golf ball in FIG. 15.
Figure 17:
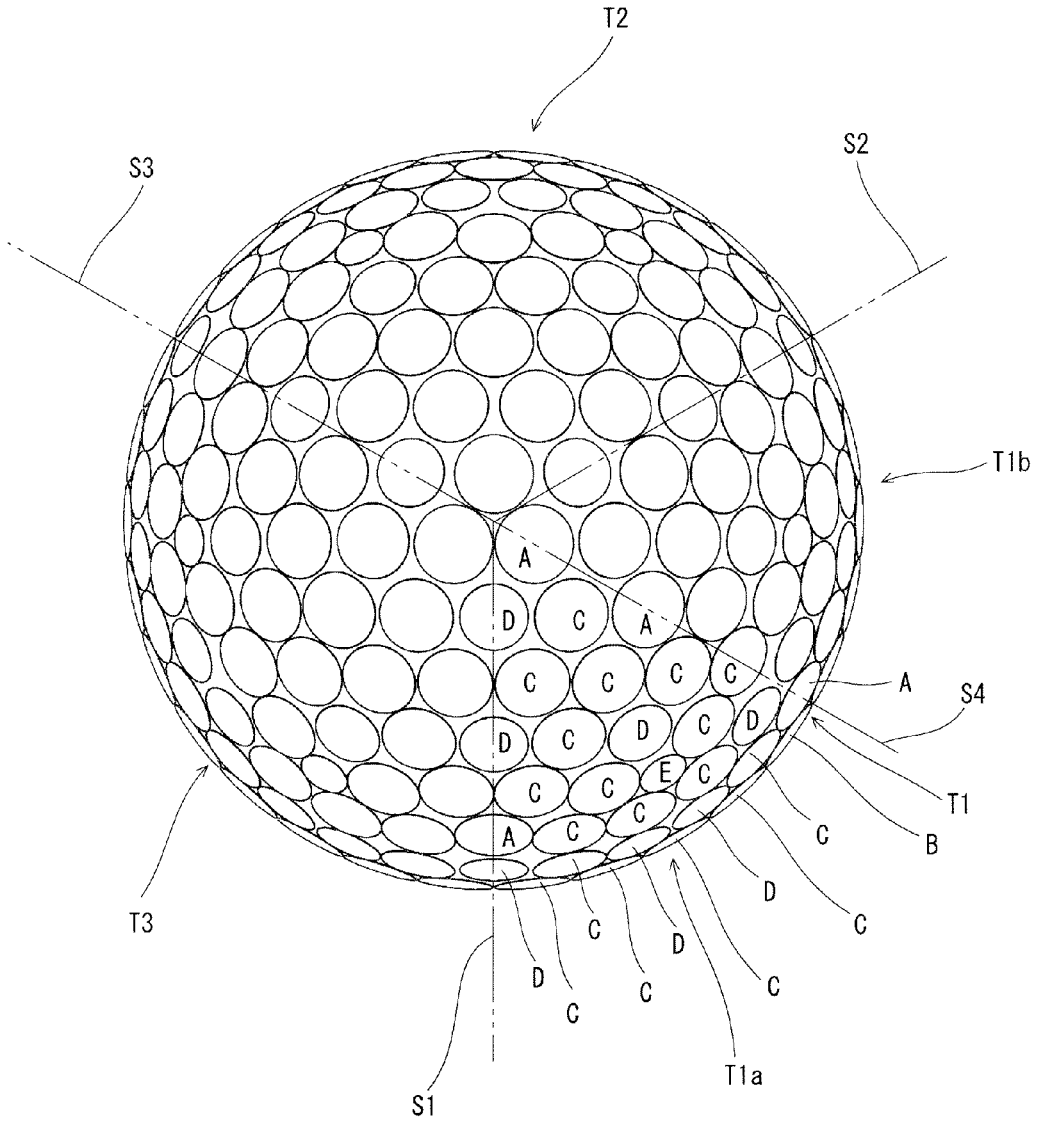
FIG. 17 is a plan view of a golf ball according to Comparative Example 3.
Figure 18:
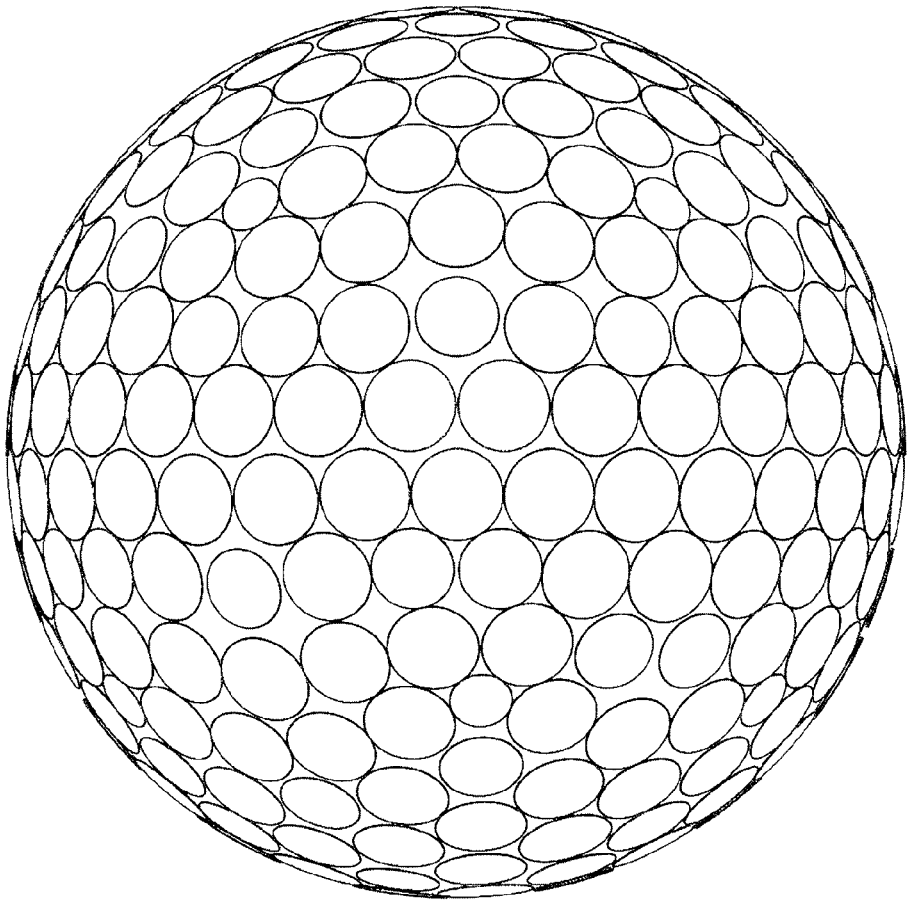
FIG. 18 is a front view of the golf ball in FIG. 17.
Figure 19:
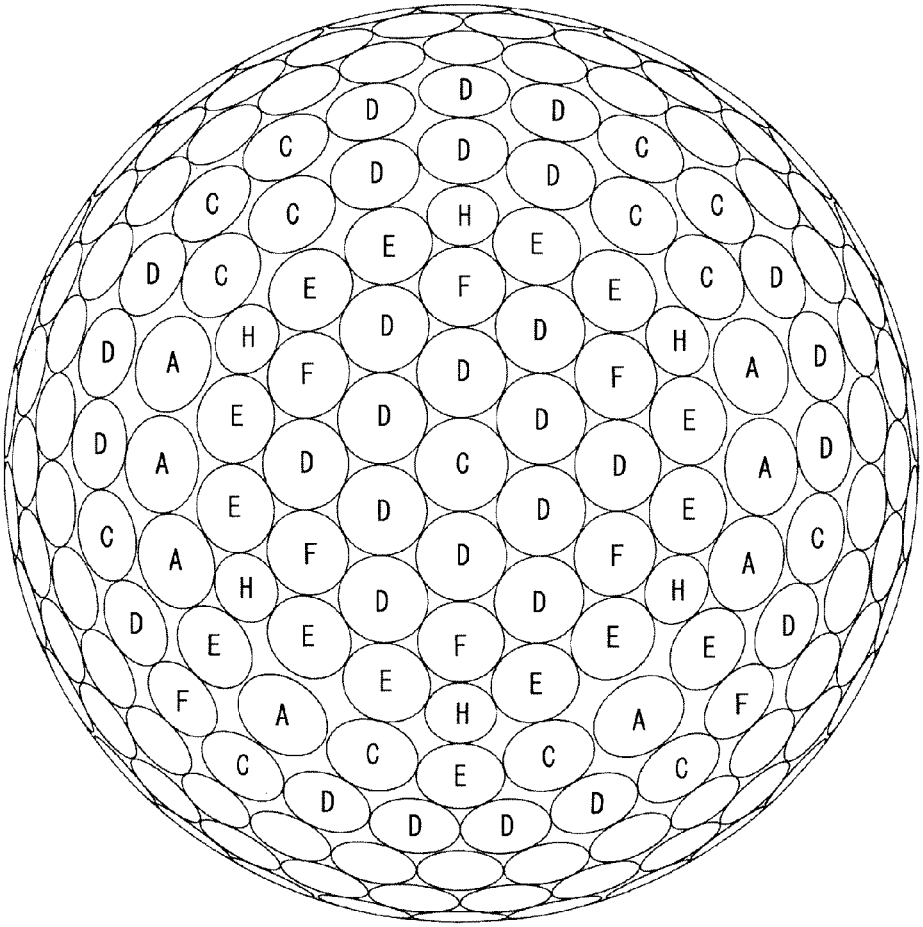
FIG. 19 is a plan view of a golf ball according to Comparative Example 4.
Figure 20:
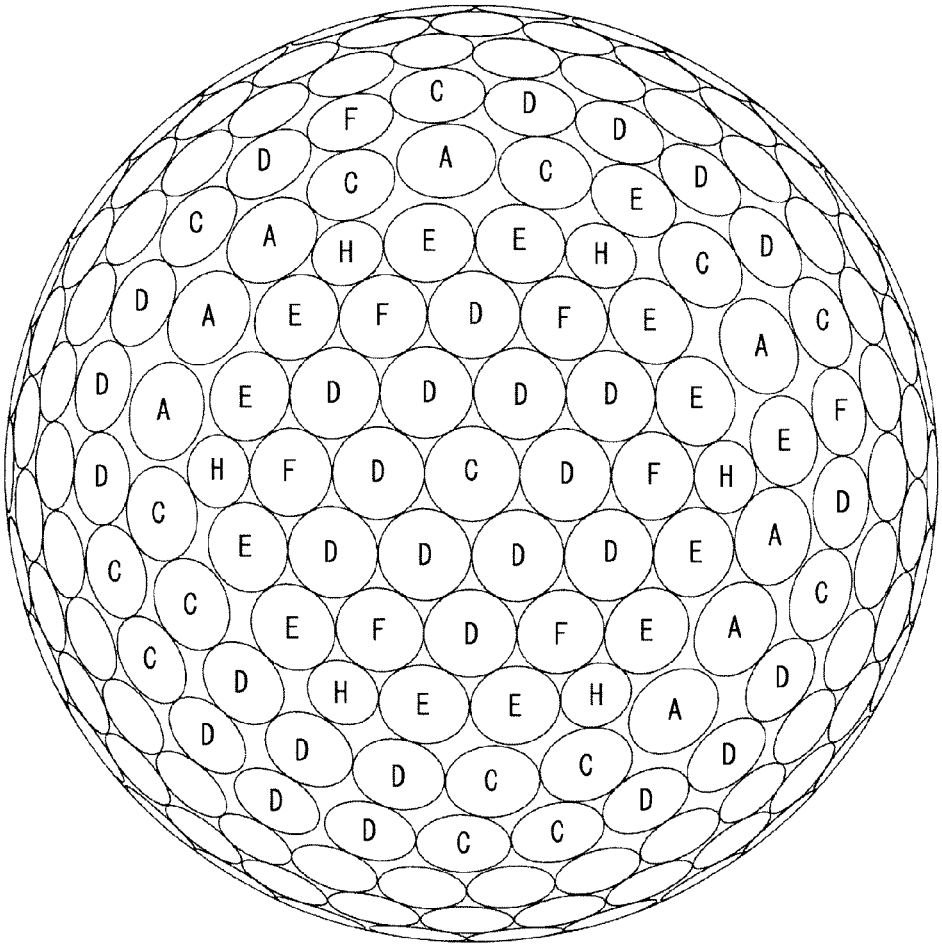
FIG. 20 is a bottom view of the golf ball in FIG. 19.
Figure 21:
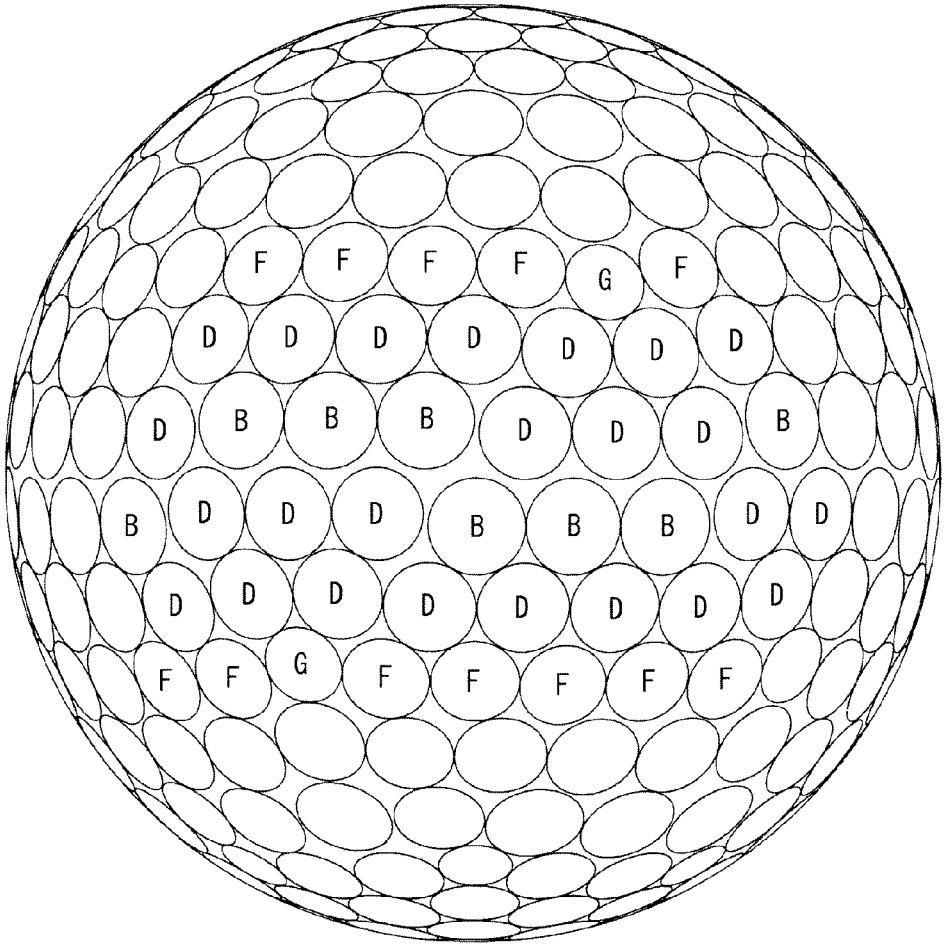
FIG. 21 is a right side view of the golf ball in FIG. 19.
Figure 22:
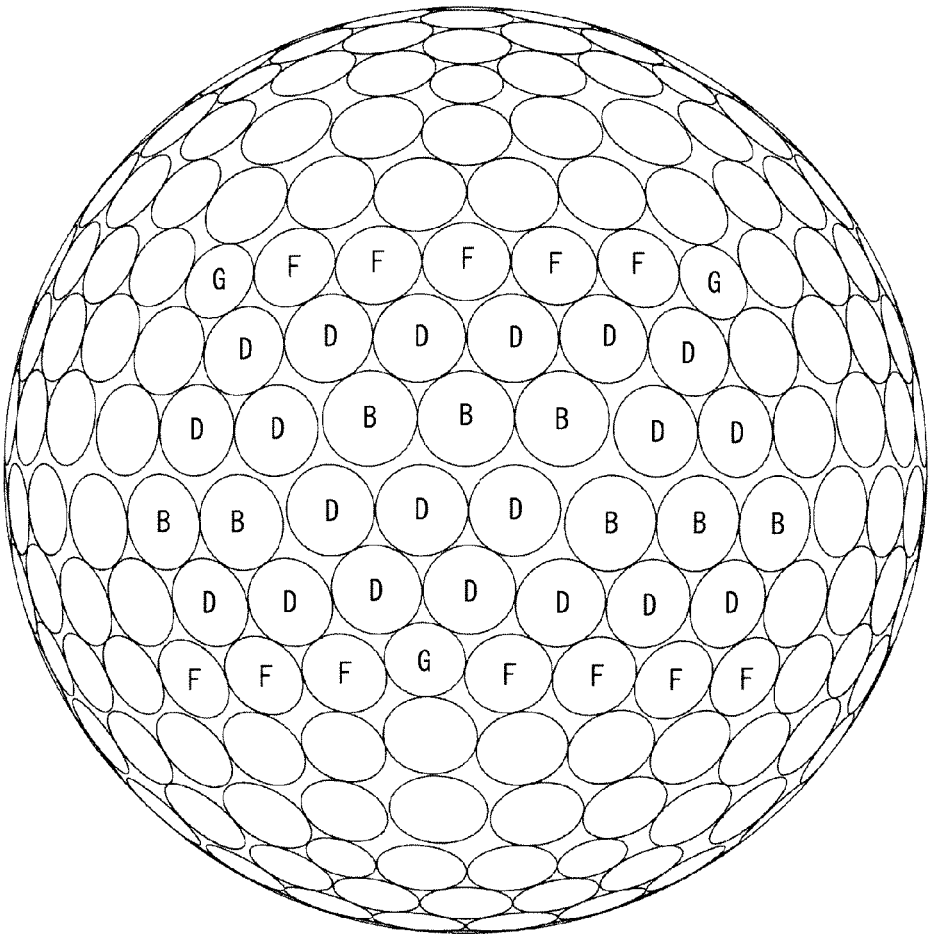
FIG. 22 is a front view of the golf ball in FIG. 19.
Figure 23:
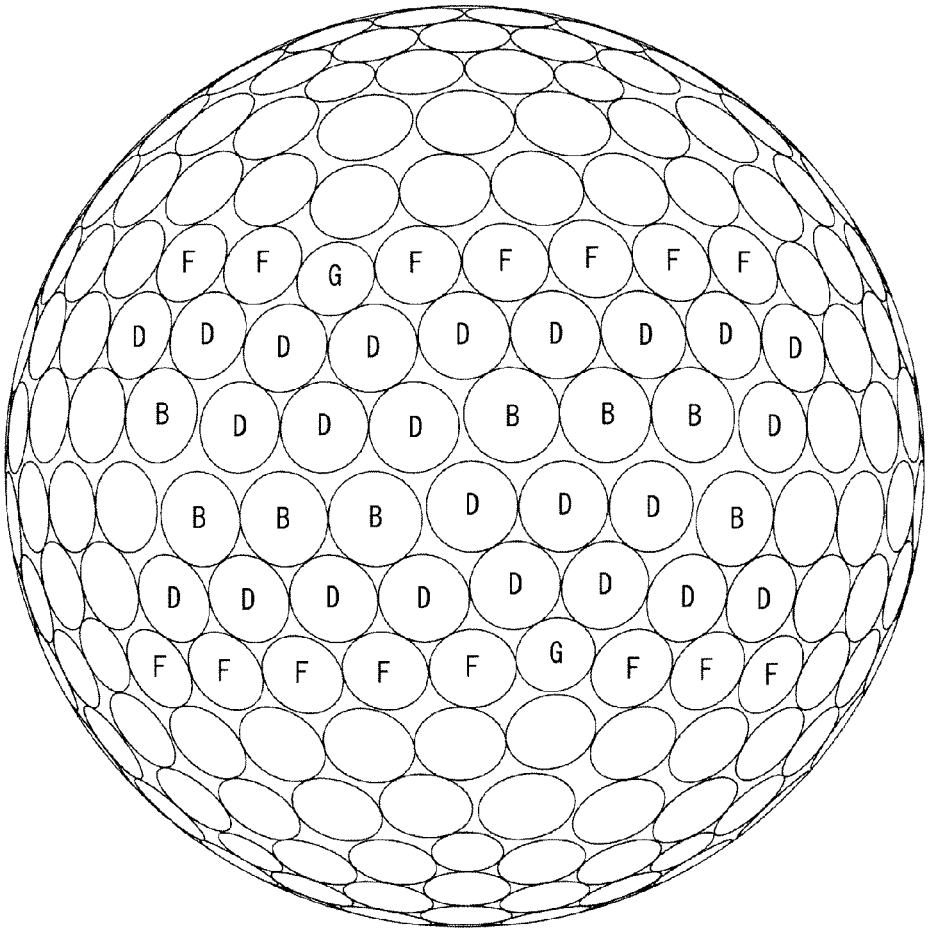
FIG. 23 is a left side view of the golf ball in FIG. 19.
Figure 24:
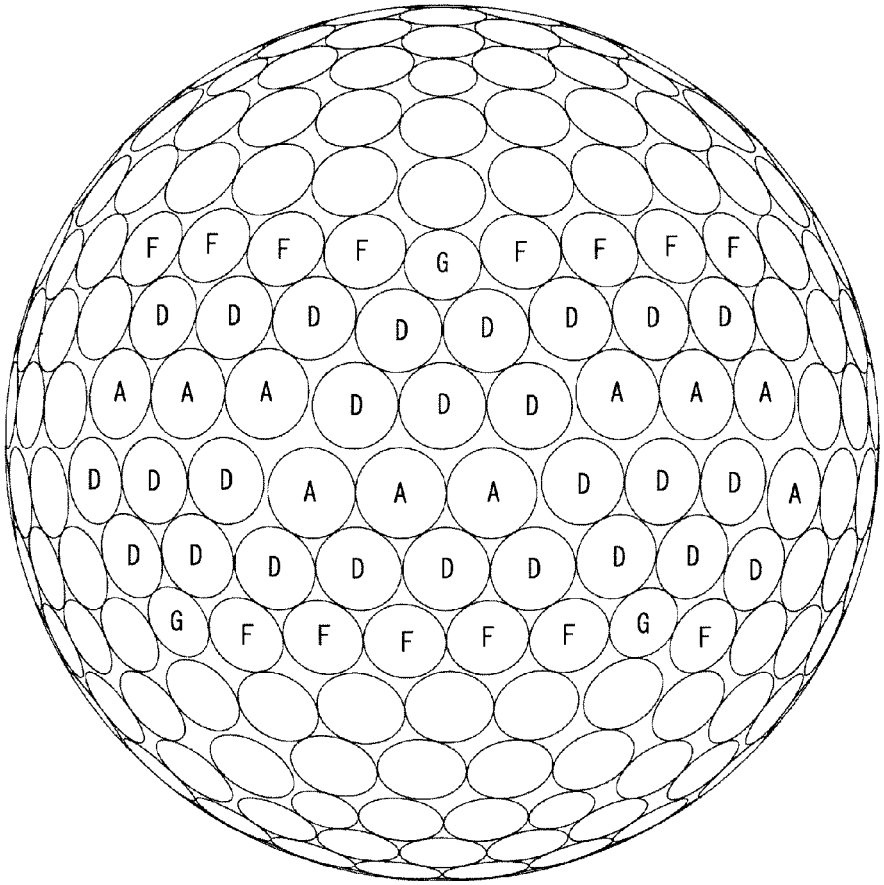
FIG. 24 is a back view of the golf ball in FIG. 19.
Figure 25:
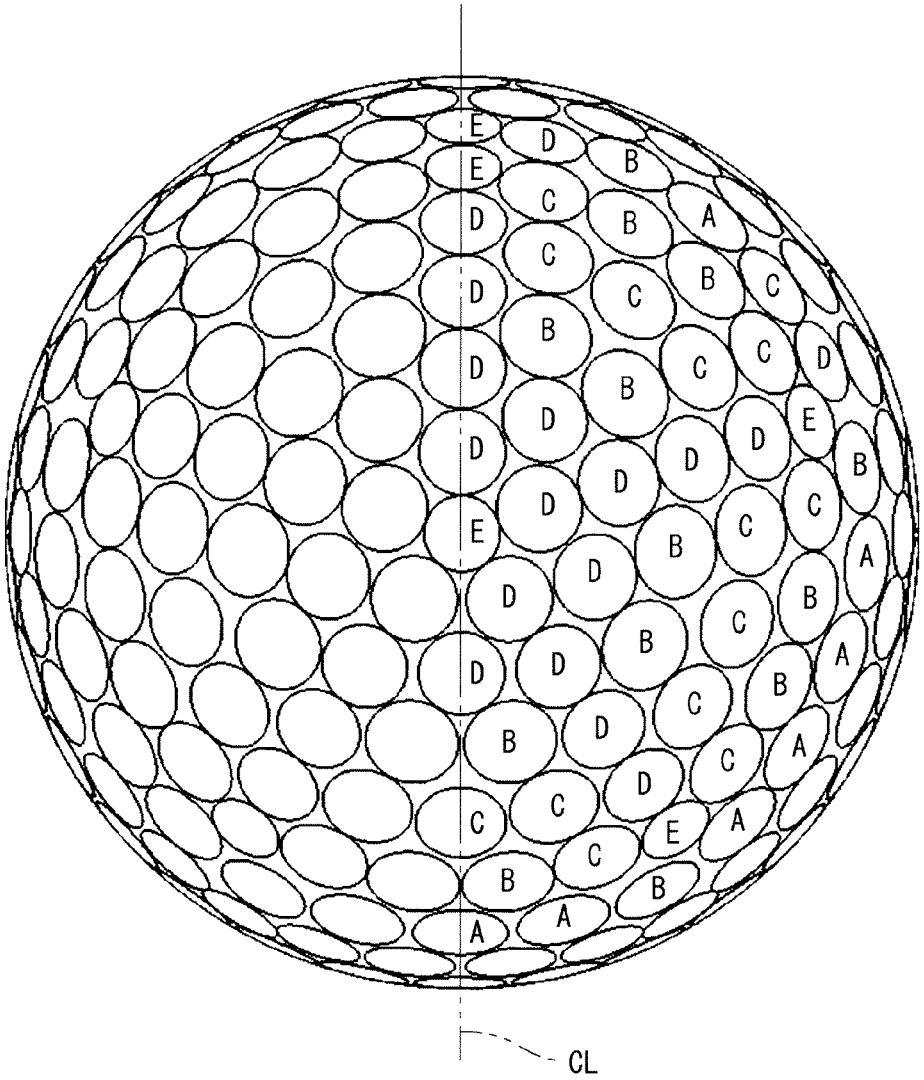
FIG. 25 is a plan view of a golf ball according to Comparative Example 5.
Figure 26:
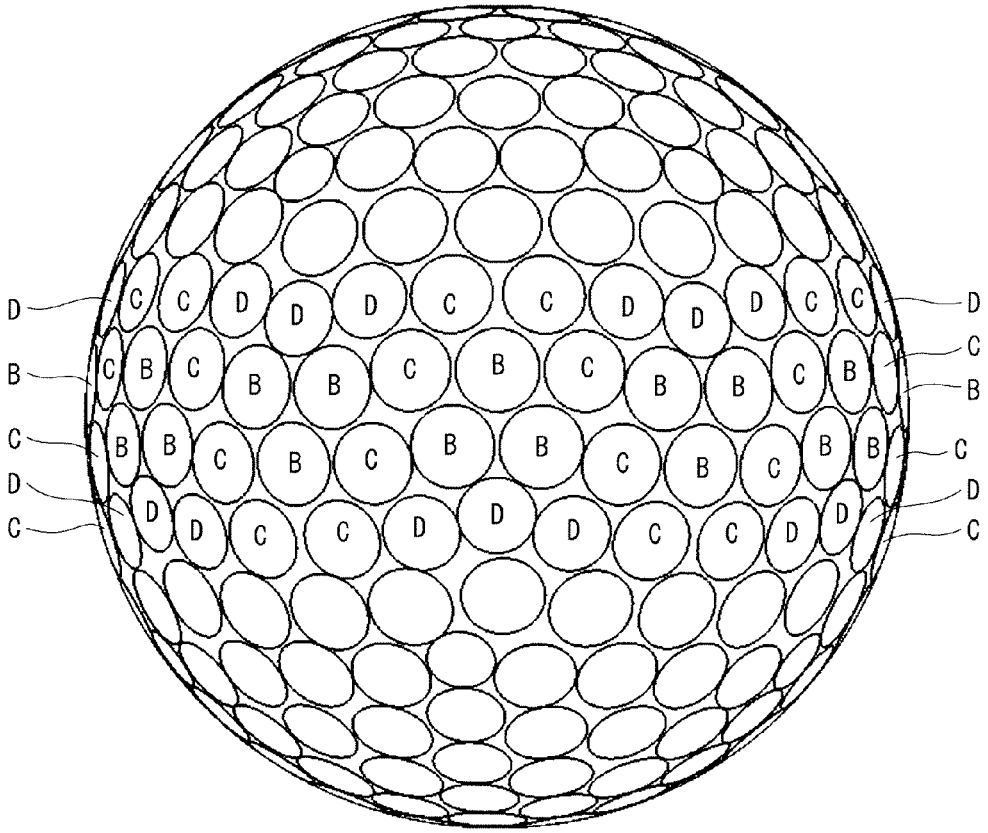
FIG. 26 is a front view of the golf ball in FIG. 25.

| Specifications of Dimples | | | | | |
|---|---|---|---|---|---|
| | D5 | D6 | D7 | D8 | D9 |
| Plan view | FIG. 13 | FIG. 15 | FIG. 17 | FIG. 19 | FIG. 25 |
| Front view | FIG. 14 | FIG. 16 | FIG. 18 | FIG. 22 | FIG. 26 |
| Number | 312 | 312 | 324 | 344 | 324 |
| Number of units | 3 | 3 | 3 | — | — |
| Number of small units | 6 | 6 | 6 | — | — |
| So (%) | 84.8 | 78.9 | 81.1 | 85.3 | 80.6 |
| Rs (%) | 34.6 | 76.9 | 64.8 | 61.0 | 87.7 |
| Rs + 2.5 * So − 273 | −26.40 | 1.15 | −5.45 | 1.25 | 16.20 |
| Mathematical formula (1) | Unsatisfied | Satisfied | Unsatisfied | Satisfied | Satisfied |
| Rs + 2.5 * So − 278 | −31.40 | −3.85 | −10.45 | −3.75 | 11.20 |
| Mathematical formula (2) | Unsatisfied | Unsatisfied | Unsatisfied | Unsatisfied | Satisfied |
| Rs + 2.5 * So − 283 | −36.40 | −8.85 | −15.45 | −8.75 | 6.20 |
| Mathematical formula (3) | Unsatisfied | Unsatisfied | Unsatisfied | Unsatisfied | Satisfied |
| Rs' (%) | 34.6 | 36.5 | 64.8 | 8.7 | 27.2 |
| Rs' + 2.2 * So − 245 | −23.84 | −34.92 | −1.78 | −48.64 | −40.48 |
| Mathematical formula (4) | Unsatisfied | Unsatisfied | Unsatisfied | Unsatisfied | Unsatisfied |

TABLE 6-continued

| Specifications of Dimples | | | | | |
|---|---|---|---|---|---|
| | D5 | D6 | D7 | D8 | D9 |
| Rs' + 2.2 * So − 252 Mathematical formula (5) | −30.84 Unsatisfied | −41.92 Unsatisfied | −8.78 Unsatisfied | −55.64 Unsatisfied | −47.48 Unsatisfied |

TABLE 7

| Results of Evaluation | | | | |
|---|---|---|---|---|
| | Ex. 2 | Ex. 3 | Ex. 1 | Ex. 4 |
| Core | One layer | One layer | One layer | One layer |
| Dimples | D2 | D3 | D1 | D4 |
| Inner layer | P4 | P4 | P4 | P4 |
| Min (kgf/cm$^2$) | 186.4 | 186.4 | 186.4 | 186.4 |
| Tin (μm) | 10 | 10 | 10 | 10 |
| Outer layer | P6 | P6 | P6 | P6 |
| Mout (kgf/cm$^2$) | 75 | 75 | 75 | 75 |
| Tout (μm) | 10 | 10 | 10 | 10 |
| Min-Mout | 111.4 | 111.4 | 111.4 | 111.4 |
| Dry | | | | |
| Spin rate (rpm) | 6520 | 6520 | 6520 | 6520 |
| Coefficient of friction | 0.608 | 0.608 | 0.608 | 0.608 |
| Wet | | | | |
| Spin rate (rpm) | 4420 | 4420 | 4420 | 4420 |
| Coefficient of friction | 0.231 | 0.231 | 0.231 | 0.231 |
| Spin ratio | 0.678 | 0.678 | 0.678 | 0.678 |
| Feel at impact | B | B | B | B |
| Flight distance (m) | 260.2 | 260.6 | 260.9 | 260.4 |

TABLE 8

| Results of Evaluation | | | | | |
|---|---|---|---|---|---|
| | Comp. Ex. 1 | Comp. Ex. 2 | Comp. Ex. 3 | Comp. Ex. 4 | Comp. Ex. 5 |
| Core | One layer | One layer | One layer | One layer | One layer |
| Dimples | D5 | D6 | D7 | D8 | D9 |
| Inner layer | P4 | P4 | P4 | P4 | P4 |
| Min (kgf/cm$^2$) | 186.4 | 186.4 | 186.4 | 186.4 | 186.4 |
| Tin (μm) | 10 | 10 | 10 | 10 | 10 |
| Outer layer | P6 | P6 | P6 | P6 | P6 |
| Mout (kgf/cm$^2$) | 75 | 75 | 75 | 75 | 75 |
| Tout (μm) | 10 | 10 | 10 | 10 | 10 |
| Min-Mout | 111.4 | 111.4 | 111.4 | 111.4 | 111.4 |
| Dry | | | | | |
| Spin rate (rpm) | 6520 | 6520 | 6520 | 6520 | 6520 |
| Coefficient of friction | 0.608 | 0.608 | 0.608 | 0.608 | 0.608 |
| Wet | | | | | |
| Spin rate (rpm) | 4420 | 4420 | 4420 | 4420 | 4420 |
| Coefficient of friction | 0.231 | 0.231 | 0.231 | 0.231 | 0.231 |
| Spin ratio | 0.678 | 0.678 | 0.678 | 0.678 | 0.678 |

TABLE 8-continued

| Results of Evaluation | | | | | |
|---|---|---|---|---|---|
| | Comp. Ex. 1 | Comp. Ex. 2 | Comp. Ex. 3 | Comp. Ex. 4 | Comp. Ex. 5 |
| Feel at impact | B | B | B | B | B |
| Flight distance (m) | 256.6 | 256.8 | 259.7 | 259.5 | 254.8 |

TABLE 9

| Results of Evaluation | | | | |
|---|---|---|---|---|
| | Ex. 5 | Ex. 6 | Ex. 7 | Ex. 8 |
| Core | One layer | One layer | One layer | One layer |
| Dimples | D1 | D1 | D1 | D1 |
| Inner layer | P2 | P3 | P5 | P2 |
| Min (kgf/cm$^2$) | 100 | 150 | 274.9 | 100 |
| Tin (μm) | 10 | 10 | 10 | 10 |
| Outer layer | P6 | P6 | P6 | P1 |
| Mout (kgf/cm$^2$) | 75 | 75 | 75 | 7.9 |
| Tout (μm) | 10 | 10 | 10 | 10 |
| Min-Mout | 25 | 75 | 199.9 | 92.1 |
| Dry | | | | |
| Spin rate (rpm) | 6450 | 6480 | 6560 | 6390 |
| Coefficient of friction | 0.618 | 0.615 | 0.601 | 0.628 |
| Wet | | | | |
| Spin rate (rpm) | 4190 | 4320 | 4480 | 4100 |
| Coefficient of friction | 0.21 | 0.224 | 0.238 | 0.196 |
| Spin ratio | 0.650 | 0.667 | 0.683 | 0.642 |
| Feel at impact | B | B | B | A |
| Flight distance (m) | 260.9 | 260.9 | 260.9 | 260.9 |

TABLE 10

| Results of Evaluation | | | | | |
|---|---|---|---|---|---|
| | Ex. 9 | Ex. 10 | Comp. Ex. 6 | Comp. Ex. 7 | Comp. Ex. 8 |
| Core | One layer | One layer | One layer | One layer | One layer |
| Dimples | D1 | D1 | D1 | D1 | D1 |
| Inner layer | P4 | P4 | P6 | P4 | P5 |
| Min (kgf/cm$^2$) | 186.4 | 186.4 | 75 | 186.4 | 274.9 |
| Tin (μm) | 10 | 10 | 10 | 10 | 10 |
| Outer layer | P1 | P7 | P6 | P4 | P5 |
| Mout (kgf/cm$^2$) | 7.9 | 8.2 | 75 | 186.4 | 274.9 |
| Tout (μm) | 10 | 10 | 10 | 10 | 10 |
| Min-Mout | 178.5 | 178.2 | 0 | 0 | 0 |

TABLE 10-continued

| Results of Evaluation | | | | | |
|---|---|---|---|---|---|
| | Ex. 9 | Ex. 10 | Comp. Ex. 6 | Comp. Ex. 7 | Comp. Ex. 8 |
| Dry | | | | | |
| Spin rate (rpm) | 6400 | 6370 | 6420 | 6580 | 6600 |
| Coefficient of friction | 0.622 | 0.631 | 0.614 | 0.598 | 0.591 |
| Wet | | | | | |
| Spin rate (rpm) | 4230 | 4210 | 3980 | 4520 | 4560 |
| Coefficient of friction | 0.219 | 0.214 | 0.192 | 0.244 | 0.248 |
| Spin ratio | 0.661 | 0.661 | 0.620 | 0.687 | 0.691 |
| Feel at impact | A | A | B | C | C |
| Flight distance (m) | 260.9 | 260.9 | 260.9 | 260.9 | 260.9 |

TABLE 11

| Results of Evaluation | | | | | |
|---|---|---|---|---|---|
| | Comp. Ex. 9 | Comp. Ex. 10 | Ex. 11 | Comp. Ex. 11 | Comp. Ex. 12 |
| Core | One layer | One layer | Two layers | Two layers | Two layers |
| Dimples | D1 | D1 | D1 | D1 | D5 |
| Inner layer | P1 | P7 | P4 | P6 | P4 |
| Min ($kgf/cm^2$) | 7.9 | 8.2 | 186.4 | 75 | 186.4 |
| Tin (μm) | 10 | 10 | 10 | 10 | 10 |
| Outer layer | P1 | P7 | P6 | P6 | P6 |
| Mout ($kgf/cm^2$) | 7.9 | 8.2 | 75 | 75 | 75 |
| Tout (μm) | 10 | 10 | 10 | 10 | 10 |
| Min-Mout | 0 | 0 | 111.4 | 0 | 111.4 |
| Dry | | | | | |
| Spin rate (rpm) | 6320 | 6280 | 6560 | 6480 | 6560 |
| Coefficient of friction | 0.645 | 0.657 | 0.608 | 0.616 | 0.608 |
| Wet | | | | | |
| Spin rate (rpm) | 3780 | 3660 | 4280 | 3890 | 4280 |
| Coefficient of friction | 0.178 | 0.171 | 0.221 | 0.186 | 0.221 |
| Spin ratio | 0.598 | 0.583 | 0.652 | 0.600 | 0.652 |
| Feel at impact | A | A | B | B | B |
| Flight distance (m) | 260.9 | 260.9 | 261.9 | 261.9 | 257.5 |

As shown in Tables 7 to 11, the golf ball of each Example is excellent in spin performance in a dry state and in a wet state and is also excellent in flight performance. From the results of evaluation, advantages of the present invention are clear.

The golf ball according to the present invention is suitable for, for example, playing golf on golf courses and practicing at driving ranges. The above descriptions are merely illustrative examples, and various modifications can be made without departing from the principles of the present invention.

What is claimed is:

1. A golf ball comprising a main body and a paint film positioned outside the main body, wherein the paint film includes an inner layer and an outer layer positioned outside the inner layer, a 10% modulus Min of the inner layer is higher than a 10% modulus Mout of the outer layer, a difference (Min−Mout) between the modulus Min and the modulus Mout is not less than 25 $kgf/cm^2$, the golf ball has a plurality of dimples on a surface thereof, a ratio So of a sum of areas of the dimples relative to a surface area of a phantom sphere of the golf ball is not less than 81.0%, a ratio Rs of a number of the dimples each having a diameter of not less than 9.60% and not greater than 10.37% of a diameter of the golf ball, relative to a total number of the dimples, is not less than 50%, a dimple pattern of each hemisphere of the phantom sphere includes three units that are rotationally symmetrical to each other, a dimple pattern of each unit includes two small units that are mirror-symmetrical to each other, and the golf ball satisfies the following mathematical formula (1):

$$Rs \geq -2.5*So+273 \quad (1).$$

2. The golf ball according to claim 1, wherein the modulus Min is not less than 100 $kgf/cm^2$.

3. The golf ball according to claim 1, wherein the modulus Mout is less than 100 kgf/cm2.

4. The golf ball according to claim 1, wherein the inner layer has a thickness Tin of not less than 5 μm and not greater than 30 μm, and the outer layer has a thickness Tout of not less than 5 μm and not greater than 30 μm.

5. The golf ball according to claim 1, wherein the inner layer is formed from a resin composition, and a base resin of the resin composition is a polyurethane.

6. The golf ball according to claim 1, wherein the outer layer is formed from a resin composition, and a base resin of the resin composition is a polyurethane.

7. The golf ball according to claim 1, wherein the golf ball satisfies the following mathematical formula (2):

$$Rs \geq -2.5*So+278 \quad (2).$$

8. The golf ball according to claim 7, wherein the golf ball satisfies the following mathematical formula (3):

$$Rs \geq -2.5*So+283 \quad (3).$$

9. The golf ball according to claim 1, wherein a ratio Rs' of a number of the dimples each having a diameter of not less than 10.10% and not greater than 10.37% of the diameter of the golf ball, relative to the total number of the dimples, is not less than 50%, and the golf ball satisfies the following mathematical formula (4):

$$Rs' \geq -2.2*So+245 \quad (4).$$

10. The golf ball according to claim 9, wherein the golf ball satisfies the following mathematical formula (5):

$$Rs' \geq -2.2*So+252 \quad (5).$$

11. The golf ball according to claim 1, wherein a depth of a deepest part of each dimple from a surface of the phantom sphere is not less than 0.10 mm and not greater than 0.65 mm.

12. The golf ball according to claim 1, wherein a total volume of the dimples is not less than 450 $mm^3$ and not greater than 750 $mm^3$.

13. The golf ball according to claim 1, wherein a total number of the dimples is not less than 250 and not greater than 450.

* * * * *